US009626839B2

(12) United States Patent
Calvert

(10) Patent No.: US 9,626,839 B2
(45) Date of Patent: Apr. 18, 2017

(54) GAMING SYSTEM AND METHOD PROVIDING AN ADDITIONAL AWARD OPPORTUNITY WHEN A DESIGNATED QUANTITY OF DISPLAYED SYMBOLS IS ASSOCIATED WITH A DISPLAYED BACKGROUND

(75) Inventor: Travis J. Calvert, Reno, NV (US)

(73) Assignee: IGT, Las Vegas, NV (US)

( * ) Notice: Subject to any disclaimer, the term of this patent is extended or adjusted under 35 U.S.C. 154(b) by 567 days.

(21) Appl. No.: 13/422,813

(22) Filed: Mar. 16, 2012

(65) Prior Publication Data

US 2013/0244749 A1 Sep. 19, 2013

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01); *G07F 17/3213* (2013.01); *G07F 17/3267* (2013.01)

(58) Field of Classification Search
USPC ..... 463/20
See application file for complete search history.

(56) References Cited

U.S. PATENT DOCUMENTS

| | | | |
|---|---|---|---|
| 1,978,395 | A | 10/1934 | Groetchen |
| 3,420,525 | A | 1/1969 | Waders |
| 3,642,287 | A | 2/1972 | Lally et al. |
| 3,735,987 | A | 5/1973 | Ohki |
| 4,332,389 | A | 6/1982 | Loyd, Jr. et al. |
| 4,365,810 | A | 12/1982 | Richardson |
| 4,373,726 | A | 2/1983 | Churchill et al. |
| 4,410,178 | A | 10/1983 | Partridge |
| 4,448,419 | A | 5/1984 | Telnaes |
| 4,455,025 | A | 6/1984 | Itkis |
| 4,582,324 | A | 4/1986 | Koza et al. |
| 4,624,459 | A | 11/1986 | Kaufman |
| 4,624,462 | A | 11/1986 | Itkis |
| 4,695,053 | A | 9/1987 | Vazquez, Jr. et al. |
| 4,756,531 | A | 7/1988 | DiRe et al. |
| 4,775,155 | A | 10/1988 | Lees |
| 4,798,387 | A | 1/1989 | Richardson |
| 4,836,546 | A | 6/1989 | DiRe et al. |
| 4,848,771 | A | 7/1989 | Richardson |
| 4,856,787 | A | 8/1989 | Itkis |
| 4,871,171 | A | 10/1989 | Rivero |
| 5,007,649 | A | 4/1991 | Richardson |
| 5,042,809 | A | 8/1991 | Richardson |
| 5,152,529 | A | 10/1992 | Okada |
| 5,205,555 | A | 4/1993 | Hamano |
| 5,242,163 | A | 9/1993 | Fulton |
| 5,259,616 | A | 11/1993 | Bergmann |

(Continued)

FOREIGN PATENT DOCUMENTS

| | | |
|---|---|---|
| AU | 1999/17318 | 9/1999 |
| EP | 0 798 676 | 10/1997 |

(Continued)

*Primary Examiner* — Tramar Harper
(74) *Attorney, Agent, or Firm* — Neal, Gerber & Eisenberg LLP

(57) ABSTRACT

Various embodiments of the present disclosure provide a gaming system and method providing an additional award opportunity when a designated quantity of displayed symbols is associated with a displayed background. For a play of a game, the gaming system displays one of a plurality of different backgrounds and a plurality of a plurality of different symbols on, over, or otherwise in addition to the displayed background. The gaming system determines and provides any awards associated with the displayed symbols. If a designated quantity of at least one of the displayed symbols is associated with the displayed background, the gaming system provides an additional award opportunity.

41 Claims, 12 Drawing Sheets

(56) References Cited

U.S. PATENT DOCUMENTS 5,297,802 A 3/1994 Pocock et al.
5,308,065 A 5/1994 Bridgeman et al.
5,324,035 A 6/1994 Morris et al.
5,324,041 A 6/1994 Boylan et al.
5,332,228 A 7/1994 Schultz
5,342,049 A 8/1994 Wichinsky et al.
5,351,970 A 10/1994 Fioretti
5,364,100 A 11/1994 Ludlow et al.
5,393,057 A 2/1995 Marnell, II
5,393,061 A 2/1995 Manship et al.
5,395,111 A 3/1995 Inoue
5,423,539 A 6/1995 Nagao
5,431,408 A 7/1995 Adams
5,449,173 A 9/1995 Thomas et al.
5,489,101 A 2/1996 Moody
5,524,888 A 6/1996 Heidel
5,531,441 A 7/1996 Dabrowski et al.
5,531,448 A 7/1996 Moody
5,531,640 A 7/1996 Inoue
5,536,016 A 7/1996 Thompson
5,542,669 A 8/1996 Charron et al.
5,560,603 A 10/1996 Seelig et al.
5,584,485 A 12/1996 Jone et al.
5,584,764 A 12/1996 Inoue
5,609,524 A 3/1997 Inoue
5,611,535 A 3/1997 Tiberio
5,622,366 A 4/1997 Inoue
5,639,088 A 6/1997 Schneider et al.
5,647,798 A 7/1997 Falciglia
5,722,891 A 3/1998 Inoue
5,732,950 A 3/1998 Moody
5,743,526 A 4/1998 Inoue
5,752,881 A 5/1998 Inoue
5,769,716 A 6/1998 Saffari et al.
5,772,506 A 6/1998 Marks et al.
5,772,509 A 6/1998 Weiss
5,775,692 A 7/1998 Watts et al.
5,788,573 A 8/1998 Baerlocher et al.
5,816,916 A 10/1998 Moody
5,823,873 A 10/1998 Moody
5,823,874 A 10/1998 Adams
5,833,540 A 11/1998 Miodunski et al.
5,848,932 A 12/1998 Adams
5,851,148 A 12/1998 Brune et al.
5,863,249 A 1/1999 Inoue
5,882,261 A 3/1999 Adams
5,885,157 A 3/1999 Harada et al.
5,908,354 A 6/1999 Okuniewicz
5,911,418 A 6/1999 Adams
5,919,088 A 7/1999 Weiss
5,919,091 A 7/1999 Bell et al.
5,935,002 A 8/1999 Falciglia
5,949,042 A 9/1999 Dietz, II et al.
5,951,397 A 9/1999 Dickinson
5,954,335 A 9/1999 Moody
5,976,016 A 11/1999 Moody et al.
5,980,384 A 11/1999 Barrie
5,984,782 A 11/1999 Inoue
5,988,643 A 11/1999 Awada
5,989,121 A 11/1999 Sakamoto
6,004,207 A 12/1999 Wilson, Jr. et al.
6,007,066 A 12/1999 Moody
6,012,983 A 1/2000 Walker et al.
6,012,984 A 1/2000 Roseman
6,015,346 A 1/2000 Bennett
6,024,640 A 2/2000 Walker et al.
6,033,307 A 3/2000 Vancura
6,056,642 A * 5/2000 Bennett ..... G07F 17/3211 273/143 R
6,059,289 A 5/2000 Vancura
6,059,658 A 5/2000 Mangano et al.
6,062,979 A 5/2000 Inoue
6,062,980 A 5/2000 Luciano
6,077,163 A 6/2000 Walker et al.
6,086,066 A 7/2000 Takeuchi et al.
6,089,976 A 7/2000 Schneider et al.
6,089,977 A 7/2000 Bennett
6,093,100 A 7/2000 Singer et al.
6,098,985 A 8/2000 Moody
6,102,798 A 8/2000 Bennett
6,105,962 A 8/2000 Malavazos et al.
6,117,009 A 9/2000 Yoseloff
6,120,031 A 9/2000 Adams
6,120,378 A 9/2000 Moody et al.
6,126,542 A 10/2000 Fier
6,129,355 A 10/2000 Hahn et al.
6,142,873 A 11/2000 Weiss et al.
6,146,276 A 11/2000 Okuniewicz
6,149,156 A 11/2000 Feola
6,149,521 A 11/2000 Sanduski
6,159,095 A 12/2000 Frohm et al.
6,159,098 A 12/2000 Slomiany et al.
6,164,652 A 12/2000 Lauretta et al.
6,168,521 B1 1/2001 Luciano
6,173,955 B1 1/2001 Perrie et al.
6,174,235 B1 1/2001 Walker et al.
6,183,361 B1 2/2001 Cummings et al.
6,190,254 B1 2/2001 Bennett
6,190,255 B1 2/2001 Thomas et al.
6,210,279 B1 4/2001 Dickinson
6,213,876 B1 4/2001 Moore, Jr.
6,220,959 B1 4/2001 Holmes, Jr. et al.
6,224,483 B1 5/2001 Mayeroff
6,227,969 B1 5/2001 Yoseloff
6,227,971 B1 5/2001 Weiss
6,231,442 B1 5/2001 Mayeroff
6,244,957 B1 6/2001 Walker et al.
6,251,013 B1 6/2001 Bennett
6,270,412 B1 8/2001 Crawford et al.
6,280,325 B1 8/2001 Fisk
6,299,165 B1 10/2001 Nagano
6,299,170 B1 10/2001 Yoseloff
6,302,398 B1 10/2001 Vecchio
6,302,790 B1 10/2001 Brossard
6,305,686 B1 10/2001 Perrie et al.
6,309,300 B1 10/2001 Glavich
6,311,976 B1 11/2001 Yoseloff et al.
6,311,978 B1 11/2001 Moody
6,312,334 B1 11/2001 Yoseloff
6,315,291 B1 11/2001 Moody
6,315,663 B1 11/2001 Sakamoto
6,319,124 B1 11/2001 Baerlocher
6,319,127 B1 11/2001 Walker et al.
6,322,078 B1 11/2001 Adams
6,328,649 B1 12/2001 Randall et al.
6,336,860 B1 1/2002 Webb
6,346,043 B1 2/2002 Colin et al.
6,347,996 B1 2/2002 Gilmore et al.
6,358,144 B1 3/2002 Kadlic et al.
6,364,313 B1 4/2002 Moody
6,368,212 B1 4/2002 Moody
6,398,218 B1 6/2002 Vancura
6,398,220 B1 6/2002 Inoue
6,419,578 B1 7/2002 Moody et al.
6,419,579 B1 7/2002 Bennett
6,419,583 B1 7/2002 Crumby et al.
6,428,412 B1 8/2002 Anderson et al.
6,435,511 B1 8/2002 Vancura et al.
6,439,993 B1 8/2002 O'Halloran
6,439,995 B1 8/2002 Hughs-Baird et al.
6,454,266 B1 9/2002 Breeding et al.
6,461,241 B1 10/2002 Webb et al.
6,471,208 B2 10/2002 Yoseloff et al.
6,471,591 B1 10/2002 Crumby
6,475,085 B2 11/2002 Moody
6,478,677 B1 11/2002 Moody
6,494,454 B2 12/2002 Adams
6,517,074 B1 2/2003 Moody et al.
6,524,185 B2 2/2003 Lind
6,533,273 B2 3/2003 Cole et al.
6,533,279 B2 3/2003 Moody et al.
6,533,664 B1 3/2003 Crumby
6,537,150 B1 3/2003 Luciano
6,561,898 B2 5/2003 Moody

(56) References Cited

U.S. PATENT DOCUMENTS 6,561,904 B2 5/2003 Locke et al.
6,568,680 B1 5/2003 Moody et al.
6,569,015 B1 5/2003 Baerlocher et al.
6,569,017 B2 5/2003 Enzminger et al.
6,575,830 B2 6/2003 Baerlocher et al.
6,585,592 B1 7/2003 Crumby
6,595,854 B2 7/2003 Hughs-Baird et al.
6,599,192 B1 7/2003 Baerlocher et al.
6,604,740 B1 8/2003 Singer et al.
6,616,142 B2 9/2003 Adams
6,616,531 B1 9/2003 Mullins
6,634,942 B2 10/2003 Walker et al.
6,638,163 B2 10/2003 Moody
6,638,170 B1 10/2003 Crumby
6,645,075 B1 11/2003 Gatto et al.
6,648,756 B2 11/2003 Moody
6,652,377 B1 11/2003 Moody
6,652,378 B2 11/2003 Cannon et al.
6,656,040 B1 12/2003 Brosnan et al.
6,656,044 B1 12/2003 Lewis
6,659,864 B2 12/2003 McGahn et al.
6,669,559 B1 12/2003 Baerlocher et al.
6,672,959 B2 1/2004 Moody et al.
6,715,756 B2 4/2004 Inoue
6,726,204 B2 4/2004 Inoue
6,729,621 B2 5/2004 Moody
6,731,313 B1 5/2004 Kaminkow
6,758,750 B2 7/2004 Baerlocher et al.
6,790,143 B2 9/2004 Crumby
6,802,773 B2 10/2004 Moody
6,802,776 B2 10/2004 Lind et al.
6,840,858 B2 1/2005 Adams
6,840,860 B1 1/2005 Okuniewicz
6,843,723 B2 1/2005 Joshi
6,852,030 B2 2/2005 Baerlocher et al.
6,866,583 B2 3/2005 Glavich et al.
6,875,110 B1 4/2005 Crumby
6,877,747 B2 4/2005 Moody
6,878,060 B2 4/2005 Moody
6,878,061 B2 4/2005 Baerlocher et al.
6,939,224 B2 9/2005 Palmer et al.
6,939,226 B1 9/2005 Joshi
6,955,356 B2 10/2005 Moody
6,960,136 B2 11/2005 Joshi et al.
6,964,416 B2 11/2005 McClintic et al.
6,964,418 B2 11/2005 Moody
6,969,317 B2 11/2005 Walker et al.
6,974,385 B2 12/2005 Joshi et al.
7,037,190 B2 5/2006 Moody et al.
7,131,500 B2 11/2006 Jomphe
7,137,628 B2 11/2006 Moody
7,140,964 B2 11/2006 Walker et al.
7,156,397 B2 1/2007 Moody et al.
7,222,857 B2 5/2007 Moody
7,222,858 B2 5/2007 Moody
7,241,221 B1 7/2007 Luciano, Jr. et al.
7,247,091 B2 7/2007 Moody
7,252,590 B2 8/2007 Palmer et al.
7,255,643 B2 8/2007 Ozaki et al.
7,316,608 B2 1/2008 Moody
7,371,171 B1 5/2008 Englman et al.
7,399,226 B2 7/2008 Mishra
7,455,586 B2 11/2008 Nguyen et al.
7,526,736 B2 4/2009 Kaminkow et al.
7,591,724 B2 9/2009 Baerlocher
7,666,091 B2 2/2010 Joshi et al.
7,695,363 B2 4/2010 Gilliland et al.
7,699,699 B2 4/2010 Gilliland et al.
7,934,989 B2 5/2011 Joshi et al.
7,997,972 B2 8/2011 Nguyen et al.
2002/0094862 A1 7/2002 Inoue
2002/0113369 A1 8/2002 Weingardt
2002/0132660 A1 9/2002 Taylor
2002/0132661 A1 9/2002 Lind et al.
2002/0142829 A1 10/2002 Inoue
2003/0040355 A1 2/2003 Baerlocher
2003/0060267 A1 3/2003 Glavich et al.
2003/0064773 A1 4/2003 Baerlocher et al.
2003/0119586 A1 6/2003 Crumby
2003/0125101 A1 7/2003 Campo
2003/0130029 A1 7/2003 Crumby
2003/0232643 A1 12/2003 Inoue
2004/0000754 A1 1/2004 Inoue
2004/0012145 A1 1/2004 Inoue
2004/0014516 A1 1/2004 Inoue
2004/0014517 A1 1/2004 Inoue
2004/0017041 A1 1/2004 Inoue
2004/0018866 A1 1/2004 Inoue
2004/0026854 A1 2/2004 Inoue
2004/0036218 A1 2/2004 Inoue
2004/0038726 A1 2/2004 Inoue
2004/0041340 A1 3/2004 Inoue
2004/0063489 A1 4/2004 Crumby
2004/0102238 A1 5/2004 Taylor
2004/0147308 A1 7/2004 Walker et al.
2005/0085294 A1 4/2005 Walker et al.
2005/0085295 A1 4/2005 Walker et al.
2005/0130729 A1 6/2005 Baerlocher et al.
2005/0164779 A1 7/2005 Okuniewicz
2005/0181854 A1 8/2005 Moshal
2005/0233798 A1 10/2005 Van Asdale
2005/0239527 A1 10/2005 Moody
2005/0239528 A1 10/2005 Moody
2005/0250578 A1 11/2005 Slomiany et al.
2005/0282607 A1* 12/2005 Gauselmann ..... G07F 17/32 463/16
2006/0025209 A1 2/2006 Walker et al.
2006/0046835 A1 3/2006 Walker et al.
2006/0142079 A1 6/2006 Ikehara et al.
2006/0166725 A1 7/2006 Saffari et al.
2006/0172794 A1 8/2006 Walker et al.
2007/0077981 A1 4/2007 Hungate et al.
2007/0155471 A1 7/2007 Powell et al.
2007/0155472 A1 7/2007 Gail et al.
2007/0155473 A1 7/2007 Powell et al.
2007/0161423 A1 7/2007 Bienvenue et al.
2007/0270204 A1 11/2007 Palmer et al.
2008/0032767 A1* 2/2008 Okada ..... G07F 17/3244 463/20
2008/0051187 A1* 2/2008 Iwamoto ..... G07F 17/32 463/20
2008/0096639 A1 4/2008 Okada
2008/0200238 A1 8/2008 Mishra
2008/0272541 A1 11/2008 Walker et al.
2009/0061996 A1 3/2009 Walker et al.
2009/0069073 A1 3/2009 Gerrard et al.
2009/0111569 A1* 4/2009 Yoshizawa ..... G07F 17/32 463/20
2009/0143135 A1* 6/2009 Yoshizawa ..... G07F 17/32 463/20
2009/0203425 A1* 8/2009 Yoshizawa ..... G07F 17/32 463/20
2009/0227354 A1* 9/2009 Johnson ..... G07F 17/3262 463/20
2009/0275387 A1* 11/2009 Yoshizawa ..... G07F 17/3267 463/20
2010/0022294 A1* 1/2010 Yoshizawa ..... G07F 17/34 463/20
2010/0048284 A1* 2/2010 Jaffe ..... G07F 17/3258 463/20
2010/0120514 A1 5/2010 Caputo
2010/0160031 A1 6/2010 Gilliland et al.
2011/0207521 A1 8/2011 Joshi et al.

FOREIGN PATENT DOCUMENTS

EP 0 926 645 6/1999
EP 0 945 837 9/1999
EP 0 984 408 3/2000
GB 2 083 936 3/1982
GB 2 096 376 10/1982
GB 2 097 160 10/1982
GB 2 117 155 10/1983

(56) References Cited

FOREIGN PATENT DOCUMENTS

| | | |
|---|---|---|
| GB | 2 170 636 | 8/1986 |
| GB | 2 183 882 | 6/1987 |
| GB | 2 226 436 | 6/1990 |
| GB | 2 328 311 | 2/1999 |
| WO | WO 99/10849 | 3/1999 |
| WO | WO 02/099760 | 12/2002 |

* cited by examiner

GAMING SYSTEM AND METHOD PROVIDING AN ADDITIONAL AWARD OPPORTUNITY WHEN A DESIGNATED QUANTITY OF DISPLAYED SYMBOLS IS ASSOCIATED WITH A DISPLAYED BACKGROUND

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines that provide players awards in primary or base games are well known. These gaming machines generally require a player to place a wager to activate a play of the primary game. For many of these gaming machines, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in higher awards being provided when they do occur.

For such known gaming machines, an amount of a wager placed on a primary game by a player may vary. For instance, a gaming machine may enable a player to wager a minimum quantity of credits, such as one credit (e.g., one cent, nickel, dime, quarter, or dollar), up to a maximum quantity of credits, such as five credits. The gaming machine may enable the player to place this wager a single time or multiple times for a single play of the primary game. For instance, a gaming machine configured to operate a slot game may have one or more paylines, and the gaming machine may enable a player to place a wager on each of the paylines for a single play of the slot game. Thus, it is known that a gaming machine, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and at substantially different rates of play.

Bonus or secondary games are also known in gaming machines. Such gaming machines usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming machine may initiate or trigger a bonus game when a bonus symbol occurs on the payline on the third reel of a three reel slot machine. The gaming machine generally indicates when a bonus game is initiated or triggered through one or more visual and/or audio output devices, such as the reels, lights, speakers, display screens, etc. Part of the enjoyment and excitement of playing certain gaming machines is the initiation or triggering of a bonus game, even before the player knows an amount of a bonus award won via the bonus game.

Certain known gaming machines randomly initiate or trigger such bonus games during play of a primary game. That is, such known gaming machines initiate or trigger such bonus games for no discernable or understandable reason from the player's perspective. As a result, player enjoyment and excitement is not maximized because the player has nothing to "root for" during play of the primary game other than a randomly occurring bonus triggering symbol, bonus triggering symbol combination, or other bonus triggering event. Accordingly, there is a need to provide a player with an additional award opportunity, such as a play of a bonus game, upon an occurrence of one or more easily discernable or understandable events to increase player enjoyment and excitement.

SUMMARY

Various embodiments of the present disclosure provide a gaming system and method providing an additional award opportunity when a designated quantity of displayed symbols is associated with a displayed background. Generally, for a play of a game, the gaming system displays one of a plurality of different backgrounds and a plurality of a plurality of different symbols on, over, or otherwise in addition to the displayed background. The gaming system determines and provides any awards associated with the displayed symbols. If a designated quantity of at least one of the displayed symbols is associated with the displayed background, the gaming system provides an additional award opportunity.

More specifically, in various embodiments, the gaming system includes a plurality of different backgrounds and is configured to operate a game including a plurality of different symbols. In certain embodiments, each of the backgrounds has and/or is associated with a different one of a plurality of different themes and/or a different one of a plurality of different identifying characteristics. In various embodiments, each of a plurality of the symbols is associated with a different one of the backgrounds. More particularly, for each of the backgrounds in such embodiments, each of any symbols associated with that background has and/or is associated with the theme associated with that background and/or the identifying characteristic associated with that background. The gaming system determines one of the backgrounds to display for a designated period, such as a period of time or a quantity of plays of the game, in one of a variety of manners, such as randomly or according to a predetermined order or schedule, and displays the determined background. For a play of the game during the designated period, the gaming system displays a plurality of the symbols on, over, or otherwise in addition to the displayed background. The gaming system determines any awards associated with the displayed symbols and provides any determined awards. The gaming system determines whether a designated quantity of at least one of the displayed symbols is associated with the displayed background. If the designated quantity of the displayed symbols is associated with the displayed background, the gaming system provides an additional award opportunity, such as a play of a bonus game.

Thus, in various embodiments, the gaming system of the present disclosure is configured to provide a player with an additional award opportunity upon an occurrence of an easily discernable or understandable event—a designated quantity of displayed symbols being associated with a displayed background—that provides the player with something to "root for" during play of the game, thereby increasing player enjoyment and excitement.

Additional features and advantages are described herein, and will be apparent from, the following Detailed Description and the Figures.

DETAILED DESCRIPTION

Figure 1:
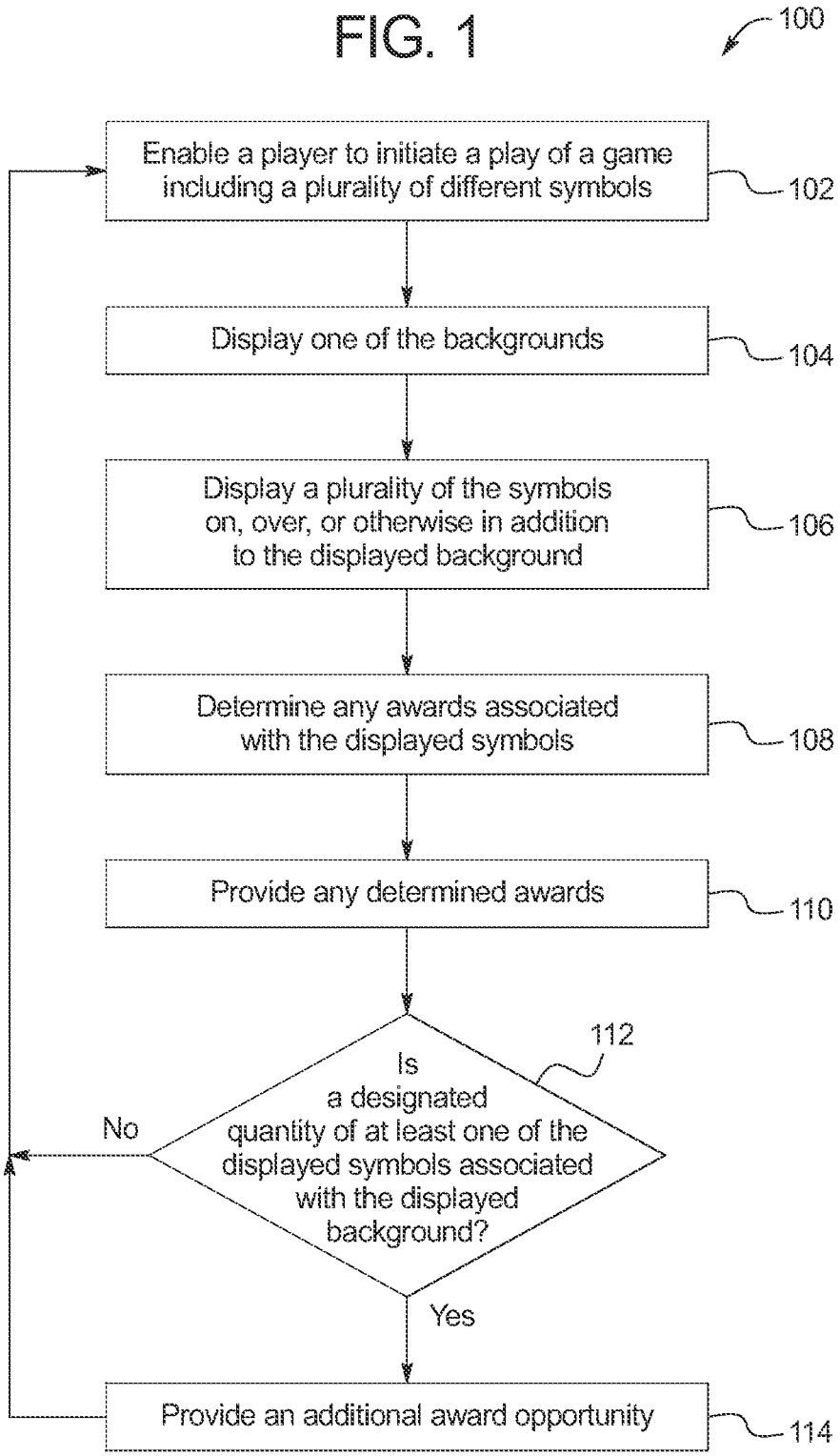
FIG. 1 is a flowchart illustrating an example method of operating an embodiment of the gaming system of the present disclosure.

Providing an Additional Award Opportunity when a Designated Quantity of Displayed Symbols is Associated with a Displayed Background Various embodiments of the present disclosure provide a gaming system and method providing an additional award opportunity when a designated quantity of displayed symbols is associated with a displayed background. The gaming system is configured to operate at least one primary or base wagering game (referred to herein as the "primary wagering game") upon a wager by a player. The primary wagering game may be any suitable wagering game such as, but not limited to: a video slot or spinning reel game; a video wheel game; a video poker, video blackjack, or other video card game; a video bingo game; a video keno game; a video roulette game; and/or a video selection game. While the present disclosure contemplates the use of any suitable wagering game as the primary wagering game, it should be appreciated that, unless otherwise indicated, in the embodiments and examples described below the primary wagering game is a video spinning reel game.

In various embodiments, the gaming system includes a plurality of different backgrounds, each of which includes one or more: colors; letters, words, and/or phrases (i.e., text); images or indicia (such as artistic renderings); and/or video clips. Each of the backgrounds has or is associated with a different one of a plurality of different themes and/or a different one of a plurality of different identifying characteristics such that each of the backgrounds, when displayed, visually differs from each of the other backgrounds. It should be appreciated that each of the backgrounds may have or be associated with any suitable theme or identifying characteristic. In one example, each of the backgrounds is associated with a different one of the following holiday themes: a New Year's theme, a Valentine's Day theme, a St. Patrick's Day theme, a Mardi Gras theme, an Easter theme, a Fourth of July theme, a Halloween theme, a Thanksgiving Theme, and a Christmas theme. In another example, each of the backgrounds is associated with a different one of the following time of day themes: a morning theme, an afternoon theme, an evening theme, and a late-night theme. In another example, each of the backgrounds is associated with a different one of the following season themes: a winter theme, a spring theme, a fall theme, and a summer theme. In one example, each of the backgrounds is associated with a different one of the following sports themes: a baseball theme, a football theme, a hockey theme, and a basketball theme. In another example, each of the backgrounds is associated with a different one of a plurality of state themes, such as an Illinois theme, a New York theme, and a California theme. In another embodiment, each of the backgrounds is associated with a different one of a plurality of country themes, such as a United States of America theme, a Canada theme, and a Mexico theme. In certain embodiments, at least one of the backgrounds is an advertisement. In one such embodiment, the advertisement is sponsored by the manufacturer of the gaming system. In another such embodiment, the advertisement is sponsored by the gaming establishment in which the gaming system is located. In another such embodiment, the advertisement is sponsored by a third party, such as a sporting goods retailer or a nail salon.

In certain embodiments, the gaming system displays one of the backgrounds for a designated period, such as a period of time or a quantity of plays of the primary wagering game. The designated period may be predetermined, randomly determined, determined by a player, determined based on game play (such as the occurrence of a designated event during game play), or determined in any other suitable manner. It should be appreciated that the designated period may be determined at any suitable time, such as prior to an expiration of a preceding designated period, contemporaneously with the expiration of the preceding designated period, or following the expiration of the preceding designated period.

The gaming system determines which of the backgrounds to display for the designated period in one or more of a variety of manners. It should be appreciated that the gaming system determines which of the backgrounds to display for the designated period at any suitable time, such as prior to the initiation of the designated period, contemporaneously with the initiation of the designated period, or after the initiation of the designated period. In certain embodiments, the gaming system randomly determines which of the backgrounds to display for the designated period. In other embodiments, the gaming system determines which of the backgrounds to display for the designated period based on the player's player tracking status or level. In further embodiments, the gaming system determines which of the backgrounds to display for the designated period based on a predetermined order or schedule (which is itself randomly determined in certain embodiments). It should be appreciated that, in such embodiments, the gaming system rotates which of the backgrounds is displayed according to the predetermined order or schedule. In further embodiments, the gaming system enables a player to determine which of the backgrounds to display for the designated period. In one such embodiment, the gaming system enables the player to select, upon an occurrence of a suitable triggering event (such as the display of a designated symbol or a designated symbol combination or the expiration of the prior designated period), which of the backgrounds to display for the designated period.

It should thus be appreciated that, in various embodiments, the gaming system determines which of the backgrounds to display for the designated period independent of any events that occur during play of the primary wagering game (or any other game).

In other embodiments, the gaming system determines which of the backgrounds to display for the designated period based on events associated with play of the primary wagering game. In one such embodiment, the gaming system determines to display one of the backgrounds when a designated symbol or a designated symbol combination associated with that background is displayed for a play of the primary wagering game. In one example, the gaming system displays a background with a beach theme for a play of the primary wagering game. In this example, the gaming system selects and displays three ski slope symbols along a wagered-on payline. Accordingly, in this example, the gaming system displays a ski-themed background for the subsequent play of the primary wagering game (i.e., for a designated period of one subsequent play of the primary wagering game). In another such embodiment, the gaming system determines which of the backgrounds to display for the designated period based on the player's rate of play of the primary wagering game.

In various embodiments, the gaming system determines which of the backgrounds to display for the designated period based on one or more events that occur in association with one or more other gaming systems. In one such embodiment, the gaming system determines to display a background associated with a jackpot award when another player in the gaming establishment in which the gaming system is located wins the jackpot award. In another such embodiment, the gaming system determines which of the backgrounds to display for the designated period based on one or more occurrences in one or more primary wagering games or bonus games played on other gaming systems.

In further embodiments, the gaming system determines which of the backgrounds to display for the designated period based on audio being output by the gaming system (such as music, a song, or a quote from a movie or a television show). In one such embodiment, the gaming system randomly determines which audio to output. Thus, in this embodiment, the gaming system determines which background to display based on the randomly determined audio outputs. In another such embodiment, the gaming system determines which audio to output based on a predetermined sequence of audio outputs. Thus, in this embodiment, the backgrounds to be displayed are predetermined based on the predetermined sequence of audio outputs. In another such embodiment, the gaming system enables the player to select which audio to output, such as by enabling the player to select which songs the gaming system will play using a touch screen or other input device. Thus, in this embodiment, the backgrounds to be displayed are determined based on the player's selection of the audio outputs.

In other embodiments, the gaming system determines a plurality of backgrounds to display simultaneously for the designated period. It should be appreciated that when multiple backgrounds are simultaneously displayed, the player has the opportunity to win multiple additional award opportunities for each play of the primary wagering game.

It should be appreciated that the gaming system may display the background on any suitable display device associated with the gaming system, such as (but not limited to) a central or main display device, a secondary or upper display device, any combination of one or more display screens of a multi-layer display device, and/or any of the display devices described below. In one embodiment in which the gaming system includes a central server, central controller, or remote host and an electronic gaming machine (EGM) (described in detail below), the central server, central controller, or remote host determines which background to display and instructs the EGM to display that background on a display device of the EGM.

The primary wagering game includes a plurality of different symbols. In certain embodiments, each of one or more of the symbols is associated with a different one of the backgrounds. In one such embodiment, only one of the symbols is associated with one of the backgrounds. In another such embodiment, each of a plurality, but less than all, of the symbols is associated with a different one of the backgrounds. In another such embodiment, each of the symbols is associated with a different one of the backgrounds. In various embodiments, each of one or more of the symbols is exclusively associated with one of the backgrounds (i.e., is not associated with any of the other backgrounds). In one such embodiment, only one of the symbols is exclusively associated with one of the backgrounds. In another such embodiment, each of a plurality, but less than all, of the symbols is exclusively associated with a different one of the backgrounds. In another such embodiment, each of the symbols is exclusively associated with a different one of the backgrounds. In other embodiments, each of one or more of the symbols is associated with a plurality of the backgrounds. In one such embodiment, only one of the symbols is associated with a plurality of the backgrounds. In another such embodiment, each of a plurality, but less than all, of the symbols is associated with a plurality of the backgrounds. In another such embodiment, each of the symbols is associated with a plurality of the backgrounds.

For each of the backgrounds, any symbol associated with that background has or is associated with the theme and/or the identifying characteristic associated with that background such that, when that symbol is displayed on, over, or otherwise in addition to that background, a player is able to recognize that that displayed symbol is associated with that displayed background. For example, one of the symbols associated with a background having a late-night theme is an image of a crescent moon. In another example, one of the symbols associated with a background having a Thanksgiving theme is an image of a turkey. In a further example, one of the symbols associated with a background having a winter theme is an image of a snowman. In certain embodiments, the gaming system causes a displayed symbol associated with a displayed background to interact with the displayed background, which helps a player recognize the association between the displayed symbol and the displayed background.

It should be appreciated that the symbols may be any suitable symbols, such as letters, numbers, characters, or other suitable images. In certain embodiments, at least one of the symbols that is associated with one of the backgrounds is included in one or more winning symbol combinations for the primary wagering game. In other embodiments, at least one of the symbols that is associated with one of the backgrounds is not included in any of the winning symbol combinations for the primary wagering game. In certain embodiments, at least one of the symbols that is associated with one of the backgrounds operates as a wild symbol. In one such embodiment, a displayed symbol associated with one of the backgrounds operates as a wild symbol when that displayed symbol is associated with the displayed background. That is, in this embodiment, a displayed symbol associated with a background that is not itself displayed does not operate as a wild symbol.

In certain embodiments, for a play of the primary wagering game, the gaming system selects and displays a plurality of the symbols on, over, or otherwise in addition to the displayed background. That is, in these embodiments, the set of symbols from which the gaming system selects the symbols to be displayed is the entire plurality of symbols. In other embodiments, for a play of the primary wagering game, the gaming system selects and displays a plurality of a subset of the symbols on, over, or otherwise in addition to the displayed background. That is, in these embodiments, the set of symbols from which the gaming system selects the symbols to be displayed is not the entire plurality of symbols. Rather, in these embodiments, the gaming system selects the symbols to be displayed from a subset of the entire plurality of symbols, wherein the subset of the entire plurality of symbols does not include the symbols associated with the non-displayed backgrounds. Put differently, in such embodiments, the subset of the plurality of symbols includes only the symbols associated with the displayed background and the symbols that are not associated with any of the backgrounds.

The gaming system determines whether a designated quantity of at least one of the displayed symbols is associated with the displayed background. It should be appreciated that the designated quantity may be any suitable quantity determined in any suitable manner. If the designated quantity of the displayed symbols is associated with the displayed background, the gaming system provides an additional award opportunity. In one embodiment, the gaming system provides the additional award opportunity as long as the designated quantity of the displayed symbols is displayed. That is, in this embodiment, it does not matter where the displayed symbols of the designated quantity of the displayed symbols are displayed. In another embodiment, the gaming system provides the additional award opportunity if the displayed symbols of the designated quantity of the displayed symbols are displayed in a predetermined order or combination (such as a pattern). In another embodiment, the gaming system provides the additional award opportunity if the displayed symbols of the designated quantity of the displayed symbols are displayed along a wagered-on payline. In another embodiment, the gaming system provides the additional award opportunity to each of a group of players as long as the displayed quantity of the designated symbols is displayed by the gaming system of each of the players of the group. In another embodiment, the gaming system provides the additional award opportunity to each of a group of players is the displayed quantity of the designated symbols is displayed in a predetermined order or combination by the gaming system of each of the players of the group. In another embodiment, the gaming system provides the additional award opportunity to each of a group of players is the displayed quantity of the designated symbols is displayed along a wagered-on payline by the gaming system of each of the players of the group.

It should be appreciated that, in certain embodiments, the gaming system determines whether the designated quantity of the displayed symbols is associated with the displayed background independent of any other award determinations made (e.g., determinations of whether any winning symbol combinations are displayed). Thus, in such embodiments, the determination of whether the designated quantity of the displayed symbols is associated with the displayed background is distinct from any other determination made with respect to a play of the primary wagering game. Similarly, in various embodiments, the gaming system determines whether the designated quantity of the displayed symbols is associated with the displayed background regardless of whether any winning symbol combinations are displayed. That is, in such embodiments, the gaming system may provide the player the additional award opportunity regardless of whether the player wins any other awards associated with the play of the primary wagering game.

It should be appreciated that the additional award opportunity may be any suitable opportunity that provides an award, enables an award to be won, increases a probability of winning an award, and/or increases an amount of an award or an amount of a potential award, such as one or more of: (a) at least one play of a bonus game; (b) an increase in an average expected payback percentage of the primary wagering game for at least one subsequent play of the primary wagering game; (c) at least one free play of the primary wagering game; (d) symbol upgrades for the play of the primary wagering game and/or for at least one subsequent play of the primary wagering game; (e) random wilds being introduced for the play of the primary wagering game and/or for at least one subsequent play of the primary wagering game; (f) stacked wilds being introduced for the play of the primary wagering game and/or for at least one subsequent play of the primary wagering game; (g) an award, such as an amount of credit or currency, an amount of non-monetary credits, an amount of player tracking credits, a product such as a car, or a comp award such as a night's stay in a hotel or show tickets; (h) an increase in any awards (such as via a multiplier) won for the play of the primary wagering game; and (i) an implementation of a cascading or tumbling reels feature (examples of which are described in U.S. Patent Application Publication Nos. 2010/0004050, 2010/0120507, and 2011/0086695) for the play of the primary wagering game or for one or more future plays of the primary wagering game.

In one embodiment, the gaming system includes a plurality of additional award opportunities, and the gaming system determines which of the additional award opportunities to provide based on a total number of the displayed symbols that are associated with the displayed background. That is, in this embodiment, different total numbers of the displayed symbols that are associated with the displayed background are associated with different additional award opportunities. In one example, when a total of one of the displayed symbols is associated with the displayed background, the gaming system provides the player with one play of a bonus game, and when a total of two of the displayed symbols are associated with the displayed background, the gaming system provides the player with two plays of the bonus game. In one such embodiment, as the total number of the displayed symbols that are associated with the displayed background increases, a value of the provided additional award opportunity increases.

In another embodiment in which the gaming system includes a plurality of additional award opportunities, each of a plurality of the backgrounds (in one embodiment, each of the backgrounds) is associated with a different one of the additional award opportunities. For example, the gaming system includes a background having a winter theme, a background having a spring theme, a background having a summer theme, and a background having a fall theme. In this example, the background having the winter theme is associated with an additional award opportunity of a free play of a selection bonus game; the background having the spring theme is associated with an additional award opportunity of a free play of the primary wagering game; the background having the summer theme is associated with an additional award opportunity of a free play of a wheel bonus game; and the background having the fall theme is associated with an additional award opportunity of a free play of a spinning reel type bonus game.

In certain embodiments, the gaming system does not provide an additional award opportunity when the designated quantity of the displayed symbols is associated with the displayed background. Rather, in these embodiments, when the designated quantity of the displayed symbols is associated with the displayed background, the gaming system makes an additional determination as to whether to provide the additional award opportunity. In one embodiment, the additional determination is a random determination based on probability tables, though it should be appreciated that the gaming system may make the additional determination in any suitable manner. In one embodiment, a probability of the gaming system determining to provide the additional award opportunity increases as a total number of the displayed symbols associated with the displayed background increases. For example, if a total of one of the displayed symbols is associated with the displayed background, there is a 10% probability of the gaming system determining to provide the additional award opportunity, and if a total of three of the displayed symbols are associated with the displayed background, there is a 30% probability of the gaming system determining to provide the additional award opportunity. In certain embodiments, when the gaming system determines not to provide the additional award opportunity when the designated quantity of the displayed symbols is associated with the displayed background, the gaming system indicates which of the displayed symbols are associated with the displayed background and indicates that the additional award opportunity was almost provided.

Although the above-described embodiments and examples describe the gaming system and method providing an additional award opportunity when a designated quantity of the displayed symbols is associated with a displayed background with respect to a primary wagering game, it should be appreciated that the present disclosure contemplates doing so with respect to a bonus or secondary game, a sub-game, a mini-game, or any other suitable game.

FIG. 1 illustrates a flowchart of an example process or method 100 for operating a gaming system of the present disclosure. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In this example, the gaming system enables a player to initiate a play of game including a plurality of different symbols, as indicated by block 102. The gaming system displays one of a plurality of different backgrounds, as indicated by block 104. Each of a plurality of the symbols is associated with a different one of the backgrounds. The gaming system displays a plurality of the symbols on, over, or otherwise in addition to the displayed background, as indicated by block 106. The gaming system determines any awards associated with the displayed symbols, as indicated by block 108, and provides any determined awards, as indicated by block 110. The gaming system determines whether a designated quantity of at least one of the displayed symbols is associated with the displayed background, as indicated by diamond 112. If not, process 100 returns to block 102. If the designated quantity of the displayed symbols is associated with the displayed background, the gaming system provides an additional award opportunity, as indicated by block 114. Process 100 returns to block 102.

FIGS. 2A, 2B, 2C, 2D, 2E, and 2F illustrate screen shots of an example of a gaming system of one embodiment of the present disclosure. This example gaming system includes three different backgrounds: a first background having a late-night theme, a second background having an under the sea theme, and a third background having a beach theme. The gaming system is configured to operate a play of a spinning reel type primary wagering game including a plurality of different symbols upon a wager by a player. Each of a plurality of the symbols is exclusively associated with a different one of the three backgrounds. More specifically, in this example, a STAR symbol is exclusively associated with the first background having the late-night theme, a FISH symbol is exclusively associated with the second background having the under the sea theme, and a SAND CASTLE symbol is exclusively associated with the third background having the beach theme.

In this example, the gaming system determines which of the backgrounds to display based on a predetermined order. In other words, the gaming system rotates which of the backgrounds is displayed according to the predetermined order. The designated period for which the determined background is displayed is, in this example, a randomly determined quantity of plays of the primary wagering game. Thus, in this example, the gaming system randomly determines a quantity of plays of the primary wagering game for which to display the determined background. Additionally, in this example, the designated quantity of the displayed symbols is one such that, for a play of the primary wagering game, when one of the displayed symbols is associated with the displayed background, the gaming system provides an additional award opportunity.

Each of the backgrounds in this example is associated with a different one of a plurality of additional award opportunities. More particularly: the first background having the late-night theme is associated with an additional award opportunity of an award of 1,000 credits; the second background having the under the sea theme is associated with an additional award opportunity of a play of a bonus game; and the third background having the beach theme is associated with an additional award opportunity of a 5× multiplier for use in each of ten subsequent plays of the primary wagering game.

The gaming system includes a display device 210 that displays one of the backgrounds 213 and a plurality of symbol display areas 220*a*, 220*b*, 220*c*, 220*d*, 220*e*, 220*f*, 220*g*, 220*h*, 220*i*, 220*j*, 220*k*, 220*l*, 220*m*, 220*n*, and 220*o*. Each of the symbol display areas is configured to display one of the symbols on, over, or otherwise in addition to displayed background 213. Display device 210 also displays a plurality of paylines for the primary wagering game, each of which is associated with a different plurality of the symbol display areas. Specifically, payline A 215*a* is associated with symbol display areas 220*a*, 220*b*, 220*c*, 220*d*, and 220*e*; payline B 215*b* is associated with symbol display areas 220*a*, 220*b*, 220*h*, 220*n*, and 220*o*; payline C 215*c* is associated with symbol display areas 220*f*, 220*g*, 220*h*, 220*i*, and 220*j*; payline D 215*d* is associated with symbol display areas 220*k*, 220*l*, 220*h*, 220*d*, and 220*e*; and payline E 215*e* is associated with symbol display areas 220*k*, 220*l*, 220*m*, 220*n*, and 220*o*. Payline A 215*a*, payline B 215*b*, payline C 215*c*, payline D 215*d*, and payline E 215*e* are sometimes referred to herein as paylines A, B, C, D, and E.

Display device 210 displays a paytable 212 for the primary wagering game, wherein paytable 212 includes a plurality of winning symbol combinations and the credit payout associated with each respective winning symbol combination. Specifically, in this example, paytable 212 includes the credit payout associated with each respective winning symbol combination when the maximum wager, which is 50 credits in this example (but could be any suitable amount), is placed for a play of the primary wagering game. Specifically, winning symbol combination SEVEN-SEVEN-SEVEN-SEVEN-SEVEN is associated with an award of 10,000 credits; winning symbol combination DIAMOND-DIAMOND-DIAMOND-DIAMOND is associated with an award of 7,500 credits, winning symbol combination DOLLAR SIGN-DOLLAR SIGN-DOLLAR SIGN-DOLLAR SIGN-DOLLAR SIGN is associated with an award of 5,000 credits; winning symbol combination TRIPLE BAR-TRIPLE BAR-TRIPLE BAR-TRIPLE BAR is associated with an award of 2,000 credits; winning symbol combination ORANGE-ORANGE-ORANGE-ORANGE is associated with an award of 500 credits; winning symbol combination DOUBLE BAR-DOUBLE BAR-DOUBLE BAR is associated with an award of 375 credits; winning symbol combination TRIPLE CHERRY-TRIPLE CHERRY-TRIPLE CHERRY is associated with an award of 250 credits; winning symbol combination BAR-BAR-BAR is associated with an award of 100 credits; and winning symbol combination CHERRY-CHERRY-CHERRY is associated with an award of 50 credits.

In this example, display device 210 also displays an indication, notification, or message display area 211, which displays information, notifications, and/or messages before, during, or after play of the primary wagering game; a credit meter 214, which displays a credit balance of the player; a wager indicator or display 216, which displays any wager placed for a play of the primary wagering game; and an award indicator or display 218, which displays any determined awards for a play of the primary wagering game.

It should be appreciated that, in various embodiments: (a) the primary wagering game may include, and the display device may display, any suitable quantity of symbol display areas in any suitable configuration or arrangement; (b) the primary wagering game may include, and the display device may display, any suitable quantity of paylines for the primary wagering game; (c) each of the displayed paylines may be associated with any suitable quantity of the symbol display areas and any suitable combination of the symbol display areas; (d) the gaming system may use any other suitable award determination other than a payline evaluation, such as a ways to win and/or a scatter pay award determination (as described below); (e) the paytable may be modified to reflect lower credit payouts when a wager that is less than the maximum wager is placed on a play of the primary wagering game; (f) any suitable paytable including any suitable quantity of winning symbol combinations may be employed; (g) any suitable combination of the symbols may be used as a winning symbol combination; (h) the winning symbol combinations may be associated with any suitable credit payouts; (i) any suitable quantity of paytables may be utilized; and (j) any suitable symbols may be employed and may include, for example, any suitable markings or indicia such as letters, numbers, or illustrations or pictures of objects.

Figure 2A:
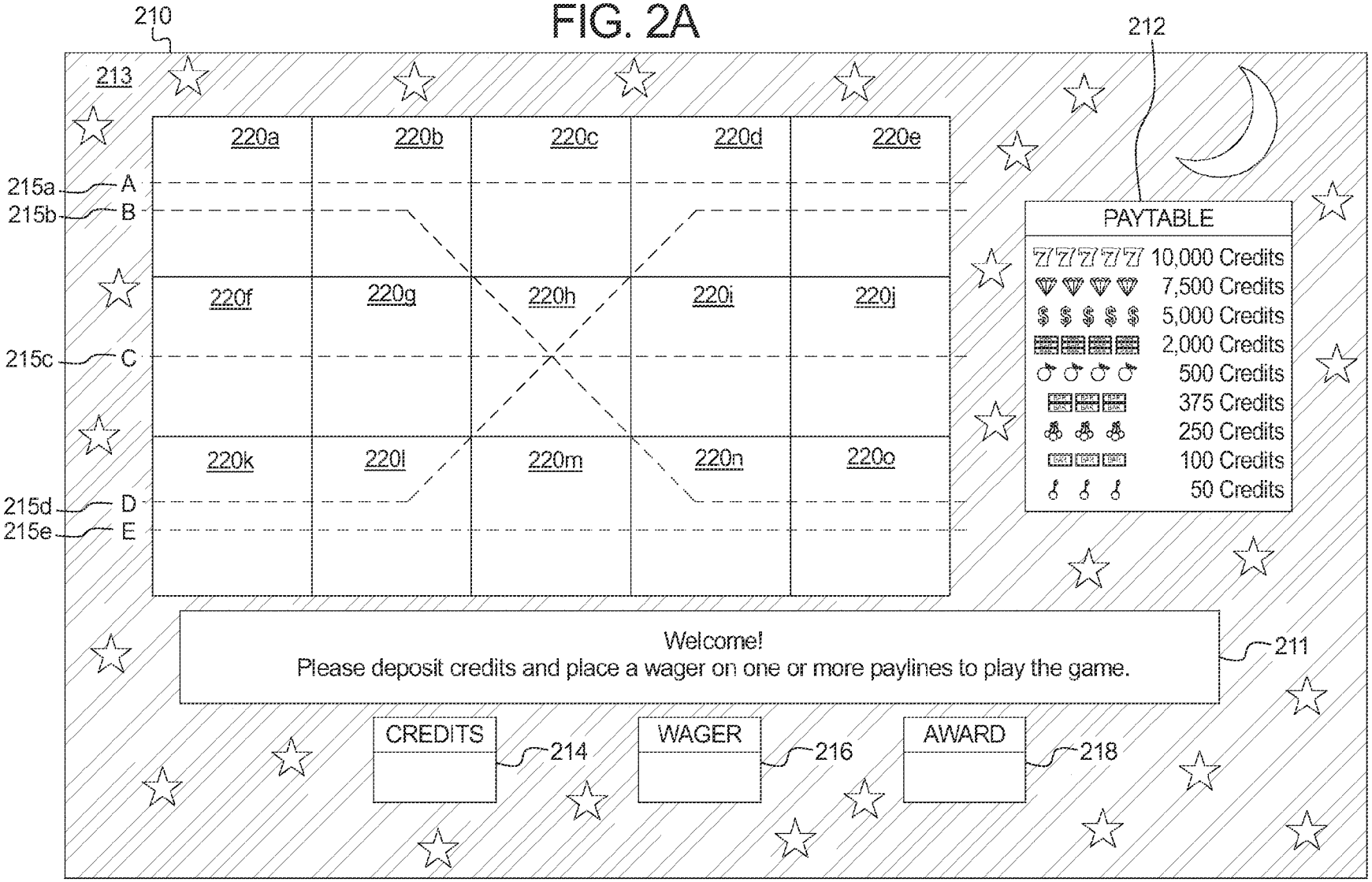
FIGS. 2A, 2B, 2C, 2D, 2E, and 2F illustrate screen shots of an example of an embodiment of the gaming system of the present disclosure configured to provide an additional award opportunity when a designated quantity of at least one of a plurality of displayed symbols matches a displayed background.

As illustrated in FIG. 2A, in this example, when the gaming system is not being played, message display area 211 displays a message that invites a player to deposit value (e.g., insert currency or a redeemable ticket having a cash value into a payment acceptor of the gaming system, as further described below) to fund the gaming system and to place a wager on one or more of the paylines to play the primary wagering game. In this example, displayed background 213 is (initially) the first background having the late-night theme, and the gaming system randomly determined to display the first background having the late-night theme for a single play of the primary wagering game (i.e., the gaming system randomly determined the designated period to be a single play of the primary wagering game).

Figure 2B:
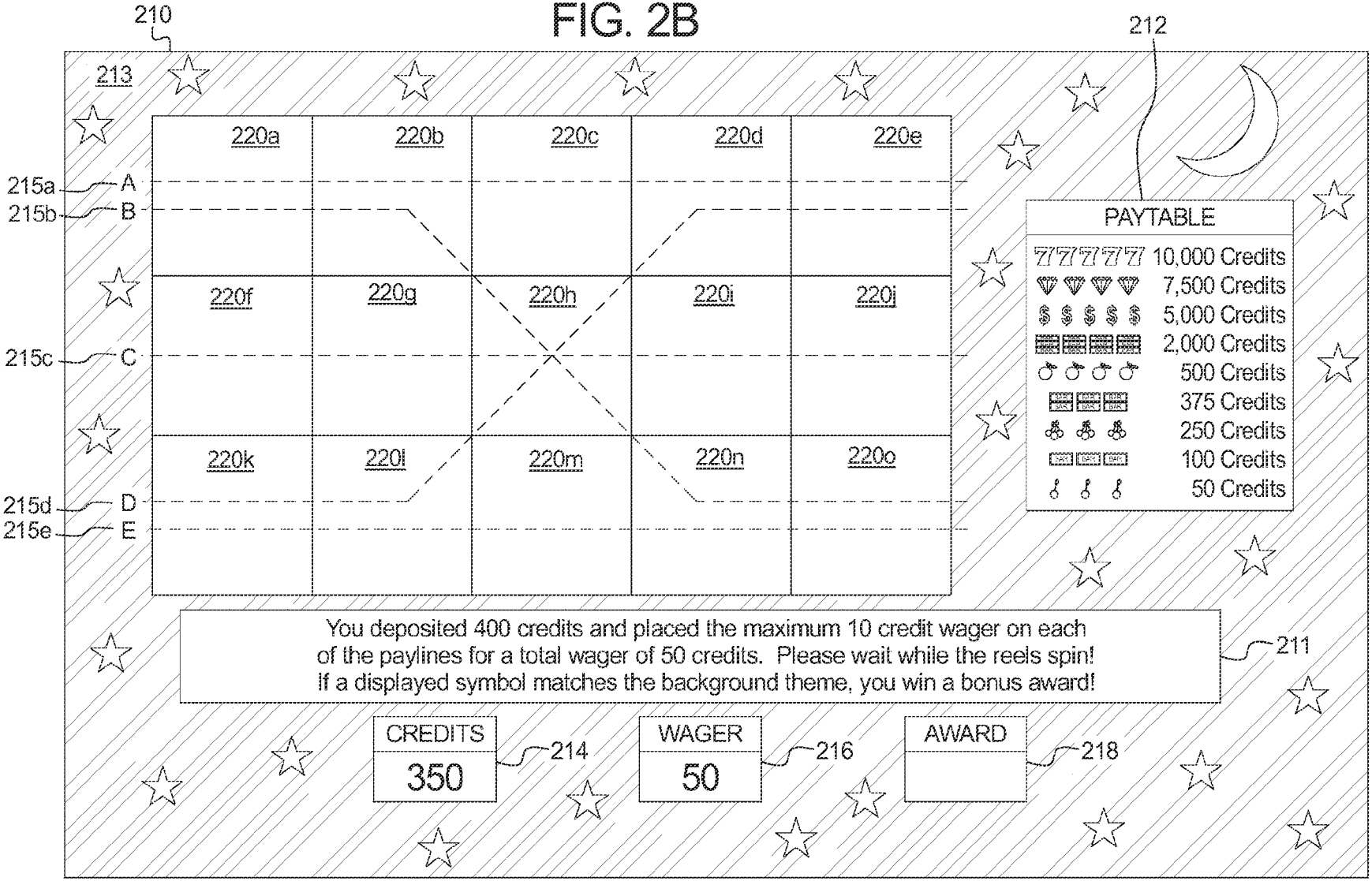

As illustrated in FIG. 2B, a player funded the gaming system by depositing value. The gaming system provided the player with 400 credits, which represent the deposited value in this example. The player subsequently placed the maximum wager of 50 credits. In this example, placement of the maximum wager activates each of paylines A, B, C, D, and E for a play of the primary wagering game. Wager indicator 216 displays the player's wager of 50 credits. Credit meter 214 displays the player's total remaining credit balance of 350 credits (i.e., the player's initial credit balance of 400 credits minus the player's wager of 50 credits). Message display area 211 displays a message notifying the player that if a symbol displayed on one of the wagered-on paylines matches the theme of the displayed background, the gaming system will provide the player a bonus award (i.e., in this example, the additional award opportunity associated with the displayed first background).

Figure 2C:
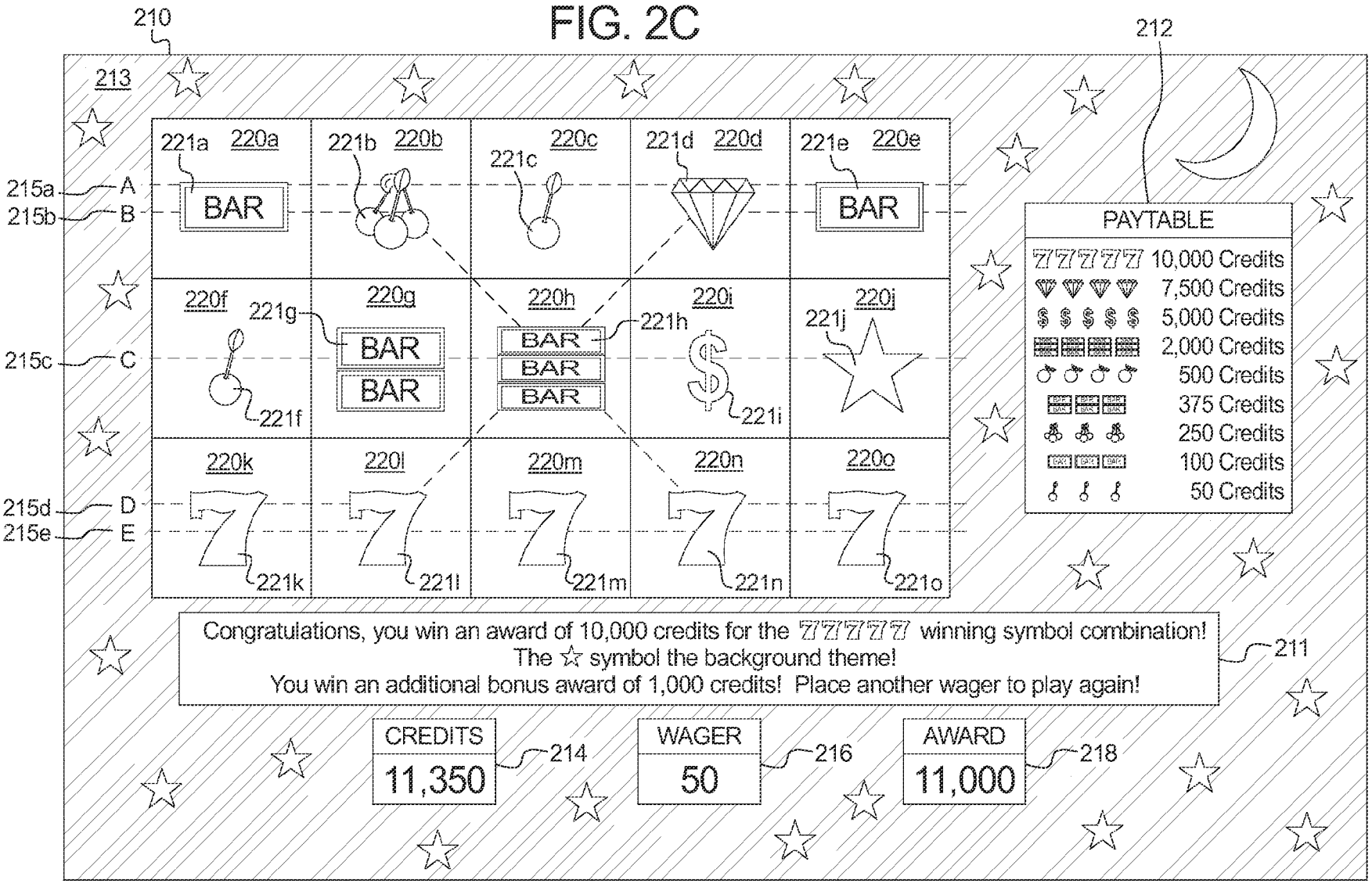

As illustrated in FIG. 2C, upon initiation of a play of the primary wagering game, the gaming system determined and displayed an outcome for the play of the primary wagering game. Specifically, the gaming system displayed BAR symbol 221*a* at symbol display area 220*a*, TRIPLE CHERRY symbol 221*b* at symbol display area 220*b*, CHERRY symbol 221*c* at symbol display area 220*c*, DIAMOND symbol 221*d* at symbol display area 220*d*, BAR symbol 221*e* at symbol display area 220*e*, CHERRY symbol 221*f* at symbol display area 220*f*, DOUBLE BAR symbol 221*g* at symbol display area 220*g*, TRIPLE BAR symbol 221*h* at symbol display area 220*h*, DOLLAR SIGN symbol 221*i* at symbol display area 220*i*, STAR symbol 221*j* at symbol display area 220*j*, SEVEN symbol 221*k* at symbol display area 220*k*, SEVEN symbol 220*l* at symbol display area 220*l*, SEVEN symbol 221*m* at symbol display area 220*m*, SEVEN symbol 221*n* at symbol display area 220*n*, and SEVEN symbol 221*o* at symbol display area 220*o*.

After displaying symbols at each of the symbol display areas, the gaming system makes an award determination. That is, the gaming system determines whether the displayed symbols form any of the winning symbol combinations included in paytable 212 along wagered-on paylines A, B, C, D, and/or E. As indicated by the message displayed in message display area 211, in this example the gaming system determined an award of 10,000 credits for the SEVEN-SEVEN-SEVEN-SEVEN-SEVEN winning symbol combination formed by SEVEN symbol 221*k*, SEVEN symbol 220*l*, SEVEN symbol 221*m*, SEVEN symbol 221*n*, and SEVEN symbol 221*o* displayed from left to right along payline E. The gaming system determines whether the designated quantity of the displayed symbols is associated with the displayed first background having the late-night theme. In this example, the designated quantity is one. Here, STAR symbol 221*j*, which is displayed along payline C, is associated with the displayed first background having the late-night theme (i.e., the designated quantity (one) of the displayed symbols is associated with the displayed background). Accordingly, the gaming system provides the player with a bonus award of 1,000 credits (i.e., provides the additional award opportunity associated with the first background having the late-night theme). Award indicator 218 displays the total award of 11,000 credits, and the player's credit balance indicated by credit meter 214 is updated to reflect the player's 11,000 credit award such that the player's total credit balance is 11,350 credits.

Figure 2D:
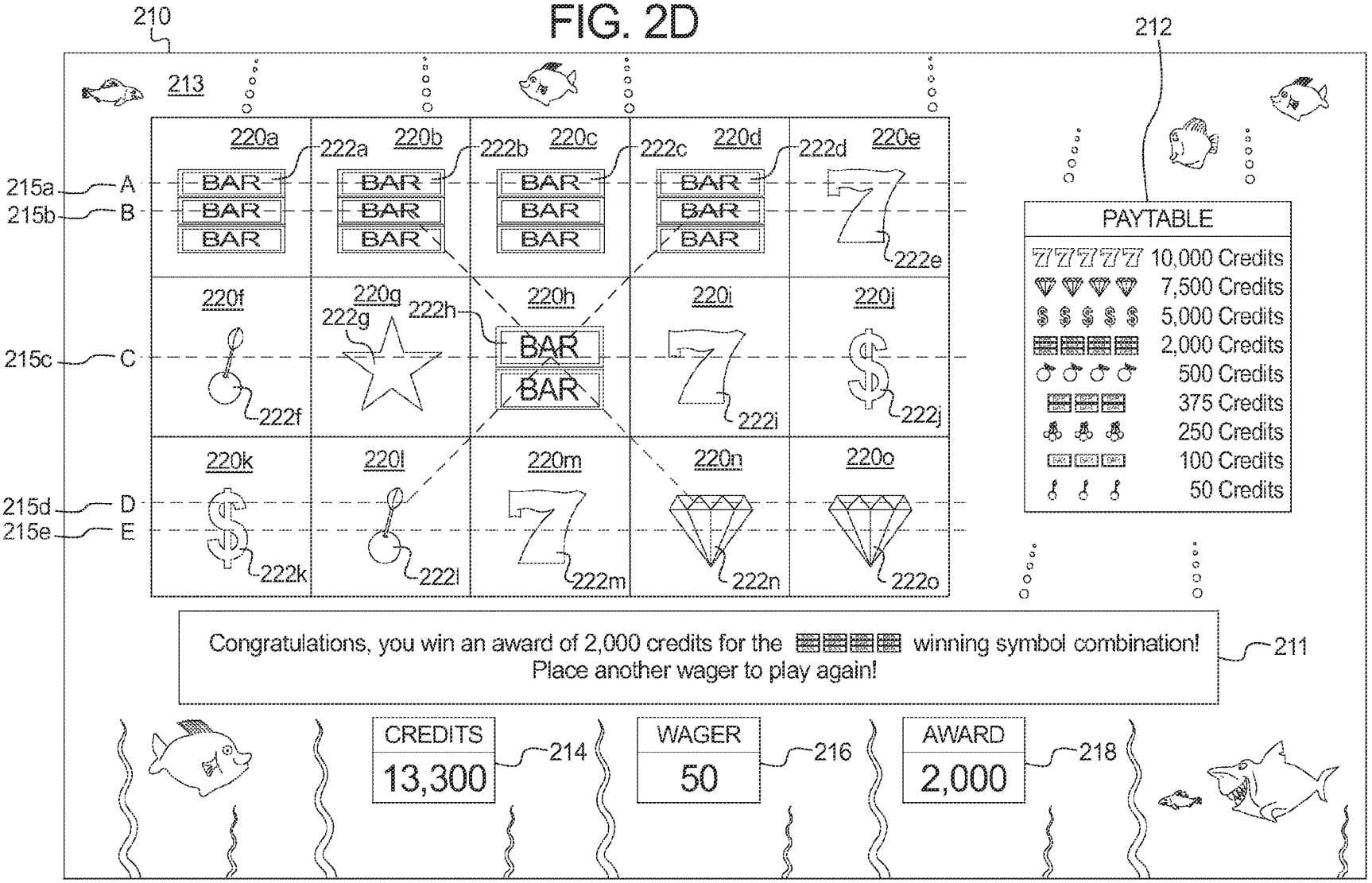

Following that play of the primary wagering game, the designated period expired and, therefore, the gaming system changed displayed background 213 to the second background having the under the sea theme in accordance with the predetermined order. The gaming system randomly determines to display the second background for two plays of the primary wagering game (i.e., the gaming system randomly determined the designated period to be two plays of the primary wagering game). FIG. 2D illustrates a screen shot of display device 210 following a subsequent play of the primary wagering game on which the player wagered 50 credits (as indicated by wager indicator 216). Specifically, the gaming system displayed TRIPLE BAR symbol 222*a* at symbol display area 220*a*, TRIPLE BAR symbol 222*b* at symbol display area 220*b*, TRIPLE BAR symbol 222*c* at symbol display area 220*c*, TRIPLE BAR symbol 222*d* at symbol display area 220*d*, SEVEN symbol 222*e* at symbol display area 220*e*, CHERRY symbol 222*f* at symbol display area 220*f*, STAR symbol 222*g* at symbol display area 220*g*, DOUBLE BAR symbol 222*h* at symbol display area 220*h*, SEVEN symbol 222*i* at symbol display area 220*i*, DOLLAR SIGN symbol 222*j* at symbol display area 220*j*, DOLLAR SIGN symbol 222*k* at symbol display area 220*k*, CHERRY symbol 222*l* at symbol display area 220*l*, SEVEN symbol 222*m* at symbol display area 220*m*, DIAMOND symbol 222*n* at symbol display area 220*n*, and DIAMOND symbol 222*o* at symbol display area 220*o*.

After displaying symbols at each of the symbol display areas, the gaming system makes an award determination. That is, the gaming system determines whether the displayed symbols form any of the winning symbol combinations included in paytable 212 along wagered-on paylines A, B, C, D, and/or E. As indicated by the message displayed in message display area 211, in this example the gaming system determined an award of 2,000 credits for the TRIPLE BAR-TRIPLE BAR-TRIPLE BAR-TRIPLE BAR winning symbol combination formed by TRIPLE BAR symbol 222*a*, TRIPLE BAR symbol 222*b*, TRIPLE BAR symbol 222*c*, and TRIPLE BAR symbol 222*d* displayed from left to right along payline A. The gaming system determines whether the designated quantity of the displayed symbols is associated with the displayed second background having the under the sea theme. In this example, none of the displayed symbols are associated with the displayed second background having the under the sea theme. More specifically, although the STAR symbol is associated with the first background having the late-night theme, STAR symbol 222*g* displayed for the current play of the primary wagering game is not associated with the second background having the under the sea theme and, therefore, does not result in the gaming system providing an additional award opportunity. Award indicator 218 displays the total award of 2,000 credits, and the player's credit balance indicated by credit meter 214 is updated to reflect the player's 2,000 credit award such that the player's total credit balance is 13,300 credits.

Figure 2E:
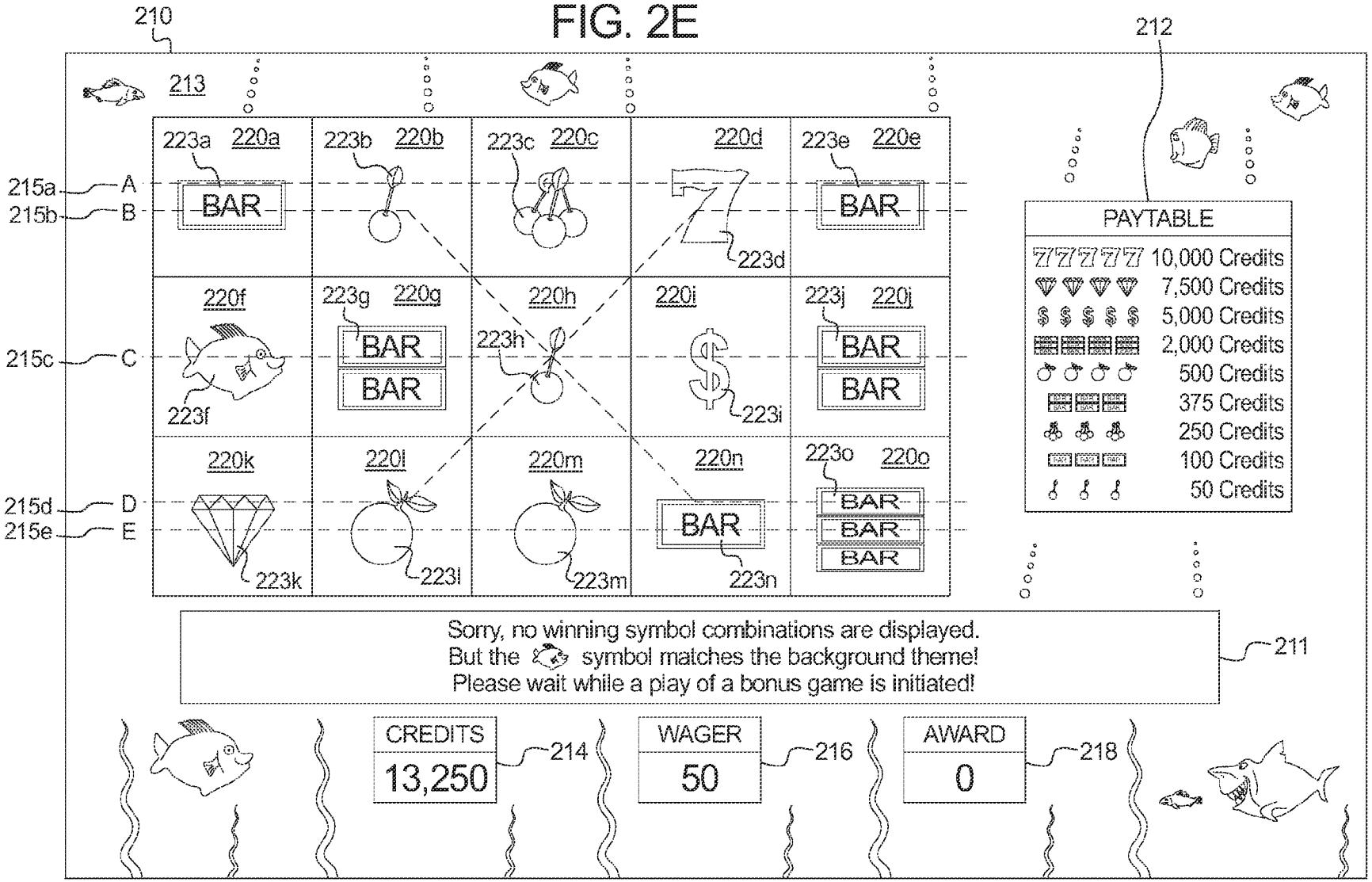

FIG. 2E illustrates a screen shot of display device 210 following a subsequent play of the primary wagering game on which the player wagered 50 credits (as indicated by wager indicator 216). Specifically, the gaming system displayed BAR symbol 223*a* at symbol display area 220*a*, CHERRY symbol 223*b* at symbol display area 220*b*, TRIPLE CHERRY symbol 223*c* at symbol display area 220*c*, SEVEN symbol 223*d* at symbol display area 220*d*, BAR symbol 223*e* at symbol display area 220*e*, FISH symbol 223*f* at symbol display area 220*f*, DOUBLE BAR symbol 223*g* at symbol display area 220*g*, CHERRY symbol 223*h* at symbol display area 220*h*, DOLLAR SIGN symbol 223*i* at symbol display area 220*i*, DOUBLE BAR symbol 223*j* at symbol display area 220*j*, DIAMOND symbol 223*k* at symbol display area 220*k*, ORANGE symbol 223*i* at symbol display area 220*l*, ORANGE symbol 223*m* at symbol display area 220*m*, BAR symbol 223*n* at symbol display area 220*n*, and TRIPLE BAR symbol 223*o* at symbol display area 220*o*.

After displaying symbols at each of the symbol display areas, the gaming system makes an award determination. That is, the gaming system determines whether the displayed symbols form any of the winning symbol combinations included in paytable 212 along wagered-on paylines A, B, C, D, and/or E. As indicated by the message displayed in message display area 211, in this example no winning symbol combinations were displayed. The gaming system determines whether any of the displayed symbols are associated with the displayed second background having the under the sea theme. In this example, FISH symbol 223*f*, which is displayed along payline C, is associated with the displayed second background having the under the sea theme. Accordingly, the gaming system provides the player with a play of a bonus game (not shown) (i.e., provides the additional award opportunity associated with the second background theme having the under the sea theme).

Figure 2F:
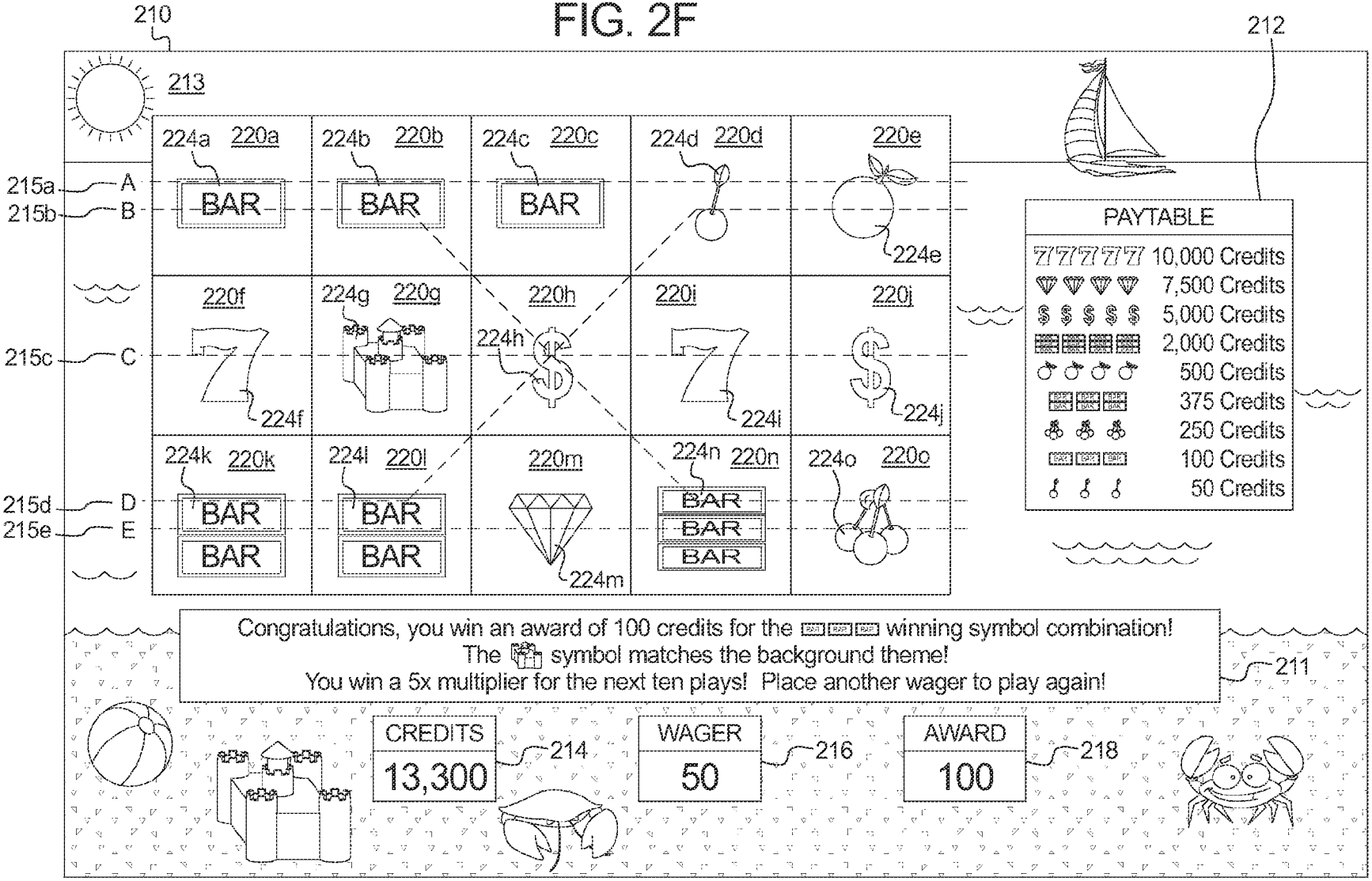

Following that play of the primary wagering game, the designated period expired and, therefore, the gaming system changed displayed background 213 to the third background having the beach theme in accordance with the predetermined order. The gaming system randomly determined to display the third background for two plays of the primary wagering game (i.e., the gaming system randomly determined the designated period to be two plays of the primary wagering game). FIG. 2F illustrates a screen shot of display device 210 following a subsequent play of the primary wagering game on which the player wagered 50 credits (as indicated by wager indicator 216). Specifically, the gaming system displayed BAR symbol 224*a* at symbol display area 220*a*, BAR symbol 224*b* at symbol display area 220*b*, BAR symbol 224*c* at symbol display area 220*c*, CHERRY symbol 224*d* at symbol display area 220*d*, ORANGE symbol 224*e* at symbol display area 220*e*, SEVEN symbol 224*f* at symbol display area 220*f*, SAND CASTLE symbol 224*g* at symbol display area 220*g*, DOLLAR SIGN symbol 224*h* at symbol display area 220*h*, SEVEN symbol 224*i* at symbol display area 220*i*, DOLLAR SIGN symbol 224*j* at symbol display area 220*j*, DOUBLE BAR symbol 224*k* at symbol display area 220*k*, DOUBLE BAR symbol 224*l* at symbol display area 220*l*, DIAMOND symbol 224*m* at symbol display area

220*m*, TRIPLE BAR symbol 224*n* at symbol display area 220*n*, and TRIPLE CHERRY symbol 224*o* at symbol display area 220*o*.

After displaying symbols at each of the symbol display areas, the gaming system makes an award determination. That is, the gaming system determines whether the displayed symbols form any of the winning symbol combinations included in paytable 212 along wagered-on paylines A, B, C, D, and/or E. As indicated by the message displayed in message display area 211, in this example the gaming system determined an award of 100 credits for the BAR-BAR-BAR winning symbol combination formed by BAR symbol 224*a*, BAR symbol 224*b*, and BAR symbol 224*c* displayed from left to right along payline A. The gaming system determines whether the designated quantity of the displayed symbols is associated with the displayed third background having the beach theme. In this example, SAND CASTLE symbol 224*g*, which is displayed along payline C, is associated with the displayed third background having the beach theme (i.e., the designated quantity (one) of the displayed symbols is associated with the displayed background). Accordingly, the gaming system provides the player with a 5× multiplier for the next ten plays of the primary wagering game (not shown) (i.e., provides the additional award opportunity associated with the third background having the beach theme). Award indicator 218 displays the award of 100 credits, and the player's credit balance indicated by credit meter 214 is updated to reflect the player's 100 credit award such that the player's total credit balance is 13,300 credits.

In certain embodiments, the gaming system includes a plurality of locked backgrounds that are unlocked upon the occurrence of one or more triggering events. For example, one locked background is unlocked after a player has played at least twenty hours in a gaming establishment. In another example, one locked background is unlocked after a player has achieved a designated quantity of coin-in. In another example, one locked background is unlocked after a player has achieved a designated quantity of winnings. In such embodiments, after a locked background is unlocked, the gaming system or a player tracking system stores data representing that locked background in association with the player such that, at a subsequent point in time, that unlocked background may be employed for a play of the primary wagering game. That is, once a player has unlocked a locked background, that unlocked background is available for use in the primary wagering game. It should be appreciated that such a system encourages players to continue play to unlock different locked backgrounds (which may be associated with different or better additional award opportunities) and use those unlocked backgrounds. In one such embodiment, the gaming system enables the player to send or transfer one or more unlocked backgrounds to one or more other players to enable those other players to use those unlocked backgrounds for plays of the primary wagering game.

In various embodiments, the gaming system includes a plurality of games and simultaneously displays and enables a player to play a plurality of the games. In certain embodiments including a plurality of simultaneously displayed games, the gaming system displays a same one of the backgrounds in association with all of the simultaneously displayed games. In one such embodiment, each of the simultaneously displayed games is associated with a same designated quantity of symbols that must be displayed for the gaming system to provide an additional award opportunity. In another such embodiment, at least two of the simultaneously displayed games are each associated with different designated quantities of symbols that must be displayed for the gaming system to provide an additional award opportunity. In another such embodiment, the gaming system provides an additional award opportunity for each of the simultaneously displayed games in which the designated quantity of the displayed symbols is associated with the displayed background. In another such embodiment, the gaming system provides an additional award opportunity only if all of the simultaneously displayed games display the designated quantity of the symbols associated with the displayed background.

In other embodiments, the gaming system displays a different one of the backgrounds in association with each of the simultaneously displayed games. In certain such embodiments, for each of the simultaneously displayed games, the gaming system provides an additional award opportunity if the designated quantity of the displayed symbols of that displayed game is associated with the background displayed in association with that displayed game. In other such embodiments, for each of the simultaneously displayed games, the gaming system provides an additional award opportunity if the designated quantity of the displayed symbols of that displayed game is associated with the background displayed in association with one of the other displayed games.

Figure 3:
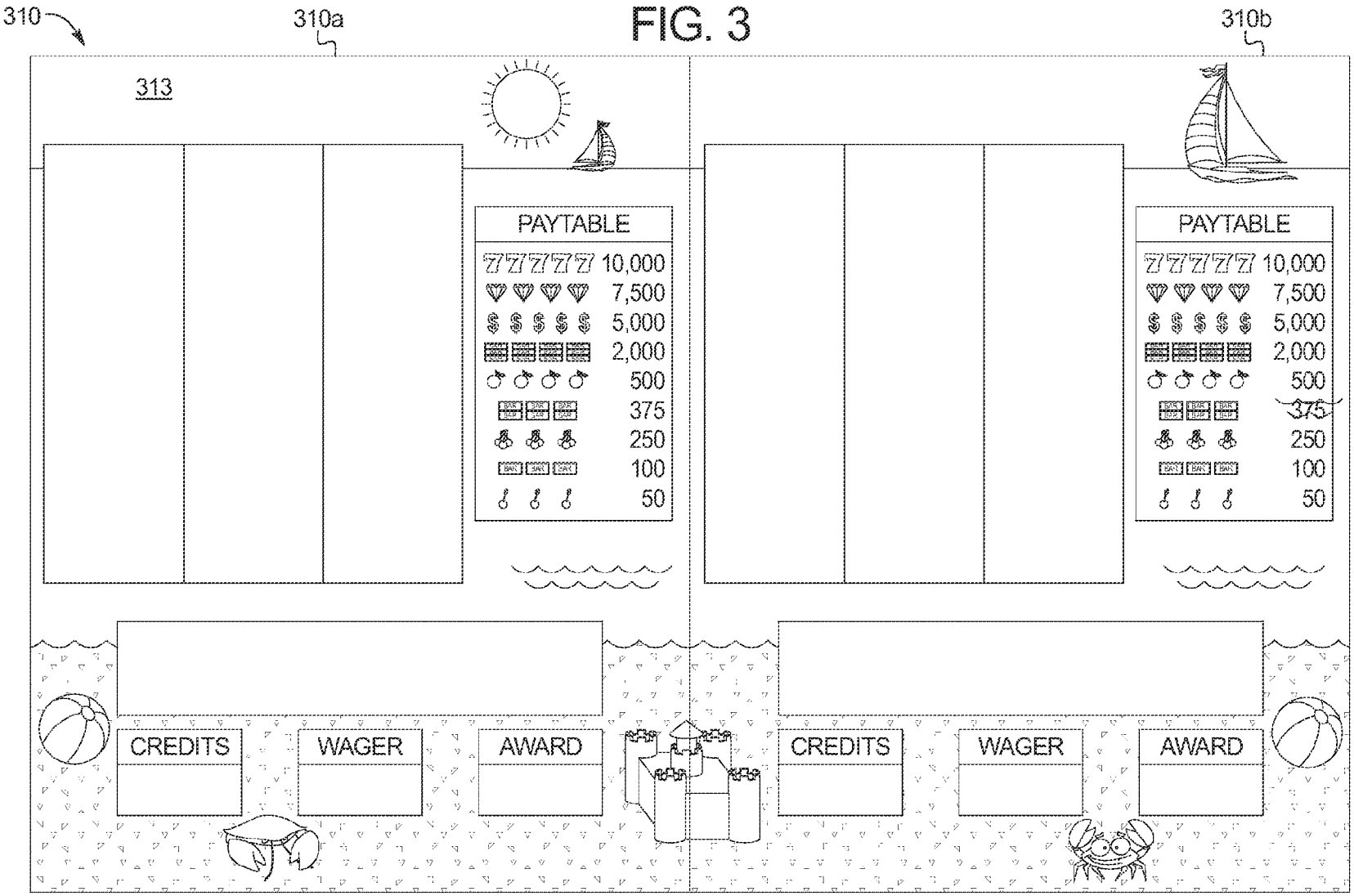
FIG. 3 illustrates a screen shot of an example of a gaming system of one embodiment of the present disclosure in which the gaming system simultaneously displays a plurality of games and a single background associated with the games.

FIG. 3 illustrates a screen shot of an example of a gaming system of one embodiment of the present disclosure in which the gaming system simultaneously displays a plurality of games. In this example, display device 310 includes first section 310*a* displaying a first wagering game and second section 310*b* displaying a second wagering game. Display device 310 also displays a single background 313 associated with both the first wagering game and the second wagering game. In this example, for each of the first wagering game and the second wagering game, if the designated quantity of the displayed symbols for that wagering game is associated with displayed background 313, the gaming system provides an additional award opportunity.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines (EGMs); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to below as an "EGM." Additionally, for brevity and clarity, unless specifically stated otherwise, "EGM" as used below represents one EGM or a plurality of EGMs, and "central server, central controller, or remote host" as used below represents one central server, central controller, or remote host or a plurality of central servers, central controllers, or remote hosts.

Figure 4A:
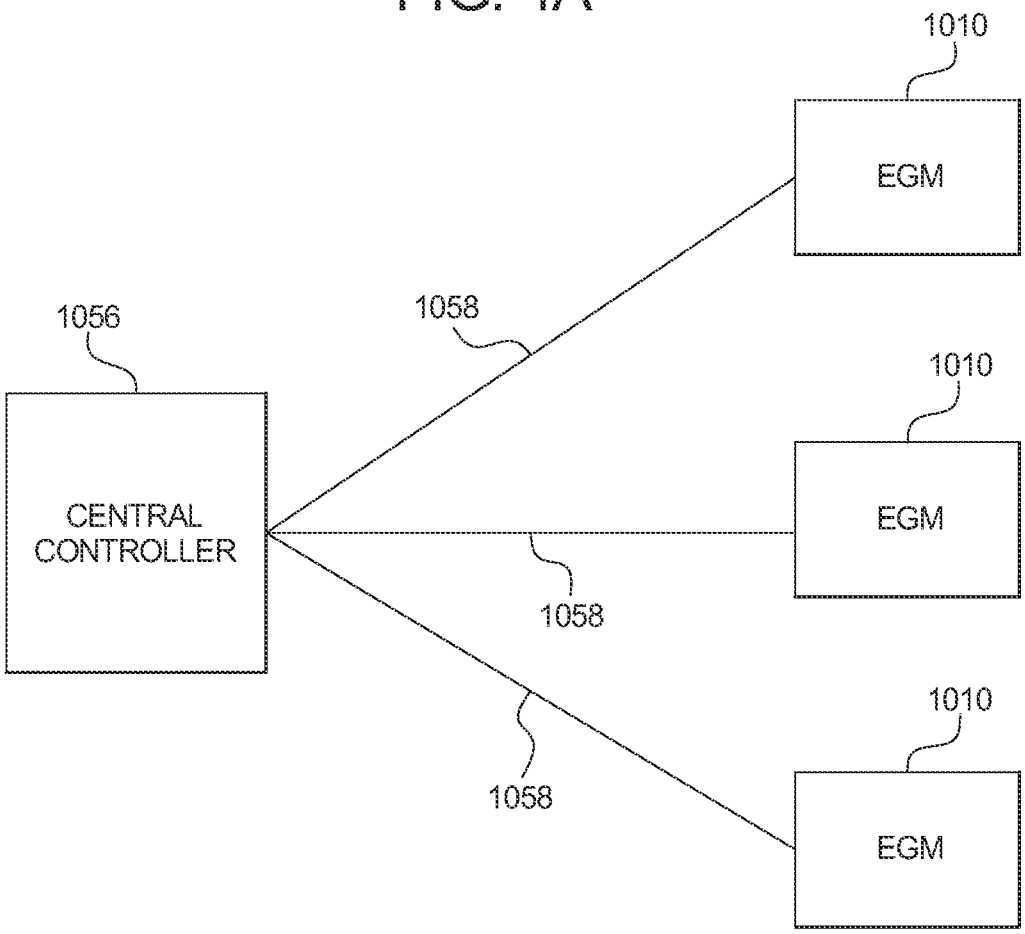
FIG. 4A is a schematic block diagram of a network configuration of one embodiment of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 4A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4B:
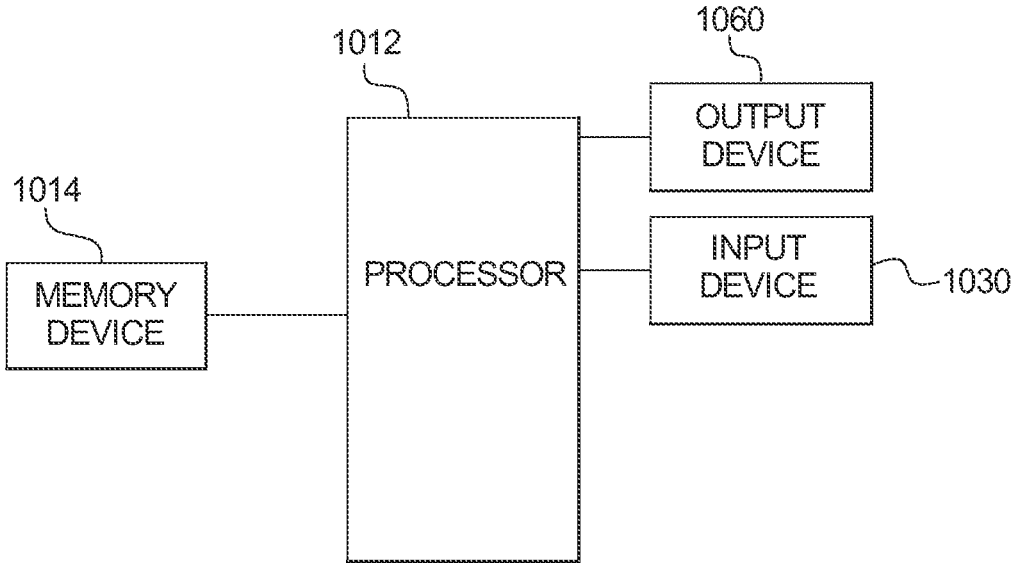
FIG. 4B is a schematic block diagram of an example electronic configuration of a gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 4B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 4B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 5A:
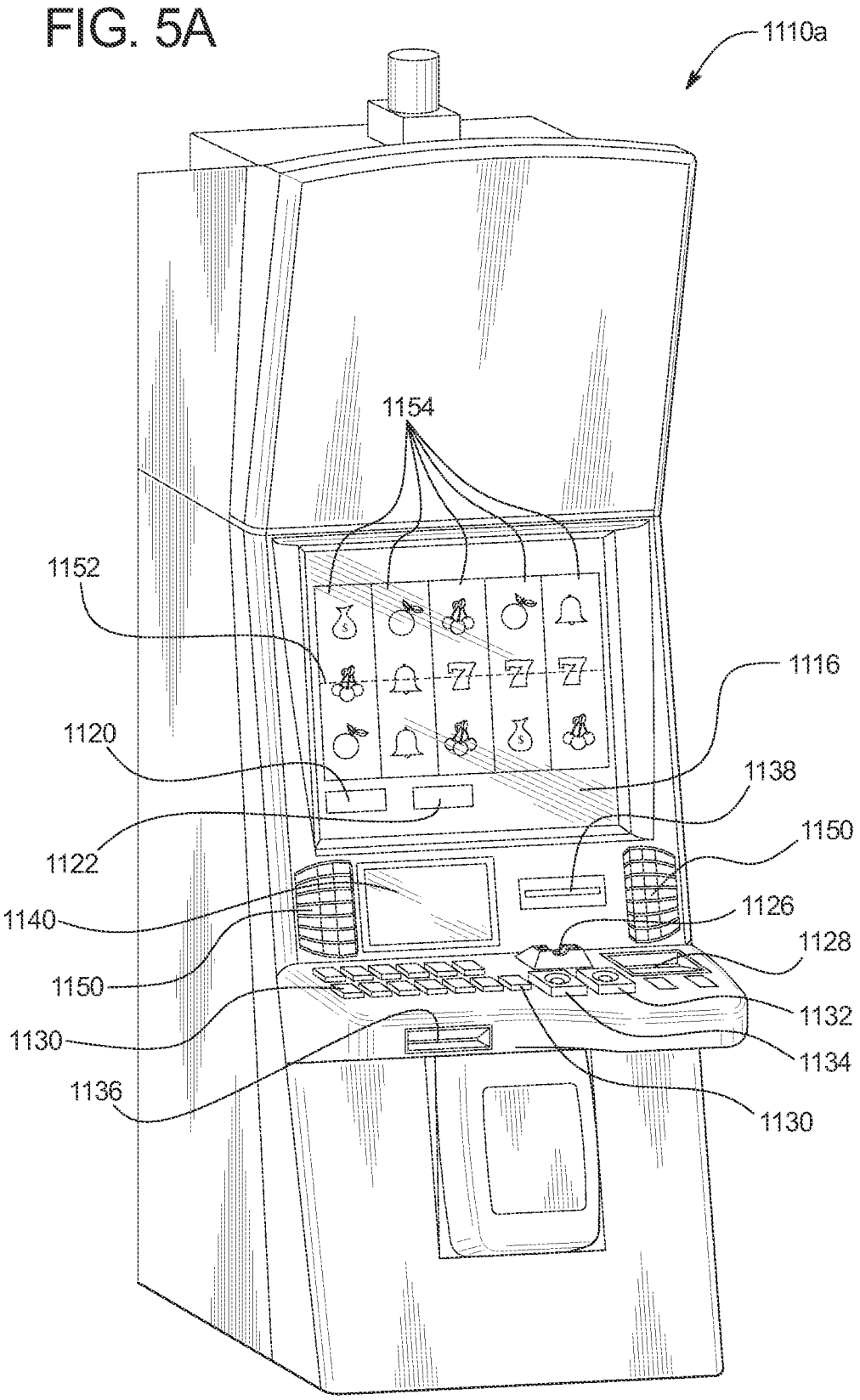
FIGS. 5A and 5B are perspective views of example alternative embodiments of the gaming system of the present disclosure.
Figure 5B:
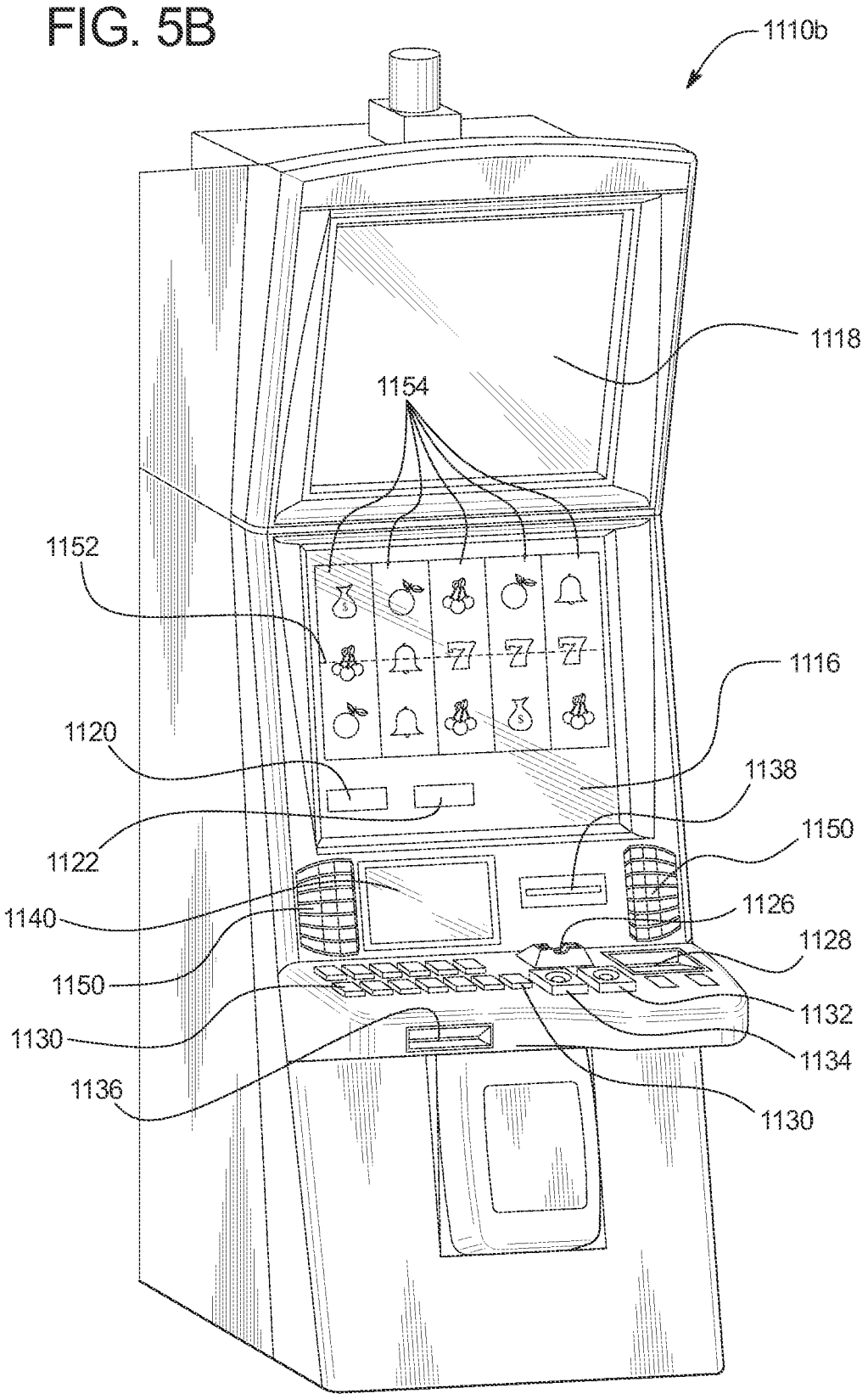

In various embodiments, the EGM includes one or more input devices. The input devices may include any suitable device that enables an input signal to be produced and received by the at least one processor of the EGM. The example EGM illustrated in FIG. 4B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 5A and 5B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 5A and 5B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 5A and 5B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 5A and 5B each include a card reader 1138. The card reader is configured to read a player identification card inserted into the card reader.

In various embodiments, the EGM includes one or more output devices. The example EGM illustrated in FIG. 4B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 5A includes a central display device 1116, a player tracking display 1140, a credit display 1120, and a bet display 1122. The example EGM illustrated in FIG. 5B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 5A and 5B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 5A and 5B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 5A and 5B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 5A and 5B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 5A and 5B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A gaming system comprising:

at least one processor;

at least one display device;

an acceptor configured to receive a physical item associated with a monetary value;

at least one input device; and at least one memory device storing a plurality of instructions which, when executed by the at least one processor, cause the at least one processor to operate with the at least one display device, the acceptor, and the at least one input device to:

(a) establish a credit balance based at least in part on the monetary value associated with the physical item responsive to receipt of the physical item by the acceptor;

(b) display a first one of a plurality of different backgrounds;

(c) for a play of a game including a plurality of symbols, a first one of the symbols having a displayed association with the first background but not with a second different one of the plurality of different backgrounds and a second one of the symbols having a displayed association with the second background but not with the first background:

(i) display a plurality of the symbols in addition to the displayed first background such that the first background is displayed at least partially around a periphery of the outermost displayed symbols;

(ii) determine any awards associated with the displayed symbols;

(iii) cause the credit balance to increase based on any determined awards; and (iv) responsive to the displayed symbols including a designated quantity of at least one instance of the first symbol having the displayed association with the displayed first background and independent of a position of the displayed at least one instance of the first symbol relative to the displayed first background, provide a first additional award opportunity including one or more plays of a bonus game, wherein the first additional award opportunity is not provided when the second background is displayed and a second triggering event associated with the second background occurs; and (d) initiate a payout associated with the credit balance responsive to an actuation of a cashout button.

2. The gaming system of claim 1, wherein the designated quantity is one.

3. The gaming system of claim 1, wherein the designated quantity is at least two.

4. The gaming system of claim 1, wherein, for each of the backgrounds, one or more of the symbols has a displayed association with said background.

5. The gaming system of claim 1, wherein at least one of the symbols has a displayed association with a plurality of the backgrounds.

6. The gaming system of claim 1, wherein, for each of the backgrounds, said background and any symbols having a displayed association with said background are associated with a same one of a plurality of different themes.

7. The gaming system of claim 1, wherein the plurality of instructions, when executed by the at least one processor, cause the at least one processor to determine to display the first background based on a predetermined order.

8. The gaming system of claim 1, wherein each of a plurality of the backgrounds is associated with a different one of a plurality of different additional award opportunities.

9. The gaming system of claim 1, wherein the plurality of instructions, when executed by the at least one processor, cause the at least one processor to operate with the at least one input device to enable a player to determine which of the backgrounds to display for a subsequent play of the game.

10. The gaming system of claim 1, wherein the game is a primary wagering game, and the plurality of instructions, when executed by the at least one processor, cause the at least one processor to place a wager for the play of the game responsive to an actuation of a wager button, the credit balance decreasable by the wager.

11. The gaming system of claim 1, wherein the plurality of instructions, when executed by the at least one processor, cause the at least one processor to, responsive to the displayed symbols including the designated quantity of the at least one instance of the first symbol having the displayed association with the displayed first background, determine whether to provide the first additional award opportunity, and provide the first additional award opportunity when the at least one processor determines to provide the first additional award opportunity.

12. The gaming system of claim 1, wherein the plurality of instructions, when executed by the at least one processor, cause the at least one processor to operate with the at least one display device to change the displayed background responsive to an occurrence of a background change event, wherein the background change event occurs responsive to one of: a change in the time of year and a change in the time of day.

13. The gaming system of claim 1, wherein the plurality of instructions, when executed by the at least one processor, cause the at least one processor to operate with the at least one display device to display the first background for a period encompassing multiple consecutive plays of the game regardless of outcomes of the plays of the game.

14. A method of operating a gaming system, said method comprising:

(a) receiving, by an acceptor, a physical item associated with a monetary value;

(b) establishing, by at least one processor, a credit balance based at least in part on the monetary value associated with the received physical item;

(c) displaying, by at least one display device, a first one of a plurality of different backgrounds;

(d) for a play of a game including a plurality of symbols, a first one of the symbols having a displayed association with the first background but not with a second different one of the plurality of different backgrounds and a second one of the symbols having a displayed association with the second background but not with the first background:

(i) displaying, by the at least one display device, a plurality of the symbols in addition to the displayed background such that the first background is displayed at least partially around a periphery of the outermost displayed symbols;

(ii) determining, by the at least one processor, any awards associated with the displayed symbols;

(iii) causing, by the at least one processor, the credit balance to increase based on any determined awards; and (iv) responsive to the displayed symbols including a designated quantity of at least one instance of the first symbol having the displayed association with the displayed first background and independent of a position of the displayed at least one instance of the first symbol relative to the displayed first background, providing a first additional award opportunity including one or more plays of a bonus game, wherein the first additional award opportunity is not provided when the second background is displayed and a second triggering event associated with the second background occurs; and (e) initiating, by the at least one processor, a payout associated with the credit balance responsive to an actuation of a cashout button.

15. The method of claim 14, wherein the designated quantity is one.

16. The method of claim 14, wherein the designated quantity is at least two.

17. The method of claim 14, wherein, for each of the backgrounds, one or more of the symbols has a displayed association with said background.

18. The method of claim 14, wherein at least one of the symbols has a displayed association with a plurality of the backgrounds.

19. The method of claim 14, wherein, for each of the backgrounds, said background and any symbols having a displayed association with said background are associated with a same one of a plurality of different themes.

20. The method of claim 14, which includes determining, by the at least one processor to display the first background based on a predetermined order.

21. The method of claim 14, wherein each of a plurality of the backgrounds is associated with a different one of a plurality of different additional award opportunities.

22. The method of claim 14, which includes enabling a player to determine which of the backgrounds to display for a subsequent play of the game.

23. The method of claim 14, wherein the game is a primary wagering game, and which includes receiving an actuation of a wager button and placing, by the at least one processor, a wager for the play of the game responsive to the actuation of the wager button, the credit balance decreasable by the wager.

24. The method of claim 14, which includes, responsive to the displayed symbols including the designated quantity of the at least one instance of the first symbol having the displayed association with the displayed first background, determining, by the at least one processor, whether to provide the first additional award opportunity, and providing the first additional award opportunity when the at least one processor determines to provide the first additional award opportunity.

25. The method of claim 14, which is at least partially provided through a data network.

26. The method of claim 25, wherein the data network is an internet-based network.

27. The method of claim 14, which includes causing, by the at least one processor, the displayed background to change responsive to an occurrence of a background change event, wherein the background change event occurs responsive to one of: a change in the time of year and a change in the time of day.

28. The method of claim 14, which includes displaying, by the at least one display device, the first background for a period encompassing multiple consecutive plays of the game regardless of outcomes of the plays of the game.

29. A non-transitory computer readable medium storing a plurality of instructions which, when executed by at least one processor, cause the at least one processor to:

(a) establish a credit balance based at least in part on the monetary value associated with a physical item responsive to receipt of the physical item by an acceptor;

(b) cause at least one display device to display a first one of a plurality of different backgrounds;

(c) for a play of a game including a plurality of symbols, a first one of the symbols having a displayed association with the first background but not with a second different one of the plurality of different backgrounds and a second one of the symbols having a displayed association with the second background but not with the first background:

(i) cause the at least one display device to display a plurality of the symbols in addition to the displayed background such that the first background is displayed at least partially around a periphery of the outermost displayed symbols;

(ii) determine any awards associated with the displayed symbols;

(iii) cause the credit balance to increase based on any determined awards;

(iv) responsive to the displayed symbols including a designated quantity of at least one instance of the first symbol having the displayed association with the displayed first background and independent of a position of the displayed at least one instance of the first symbol relative to the displayed background, provide a first additional award opportunity including one or more plays of a bonus game, wherein the first additional award opportunity is not provided when the second background is displayed and a second triggering event associated with the second background occurs; and (d) initiate a payout associated with the credit balance responsive to an actuation of a cashout button.

30. The non-transitory computer readable medium of claim 29, wherein the designated quantity is one.

31. The non-transitory computer readable medium of claim 29, wherein the designated quantity is at least two.

32. The non-transitory computer readable medium of claim 29, wherein, for each of the backgrounds, one or more of the symbols has a displayed association with said background.

33. The non-transitory computer readable medium of claim 29, wherein at least one of the symbols has a displayed association with a plurality of the backgrounds.

34. The non-transitory computer readable medium of claim 29, wherein, for each of the backgrounds, said background and any symbols having a displayed association with said background are associated with a same one of a plurality of different themes.

35. The non-transitory computer readable medium of claim 29, wherein the plurality of instructions, when executed by the at least one processor, cause the at least one processor to determine to display the first background based on a predetermined order.

36. The non-transitory computer readable medium of claim 29, wherein each of a plurality of the backgrounds is associated with a different one of a plurality of different additional award opportunities.

37. The non-transitory computer readable medium of claim 29, wherein the plurality of instructions, when executed by the at least one processor, cause the at least one processor to operate with at least one input device to enable a player to determine which of the backgrounds to display for a subsequent play of the game.

38. The non-transitory computer readable medium of claim 29, wherein the game is a primary wagering game, and the plurality of instructions, when executed by the at least one processor, cause the at least one processor to place a wager for the play of the game responsive to an actuation of a wager button, the credit balance decreasable by the wager.

39. The non-transitory computer readable medium of claim 29, wherein the plurality of instructions, when executed by the at least one processor, cause the at least one processor to, responsive to the displayed symbols including the designated quantity of the at least one instance of the first symbol having the displayed association with the displayed first background, determine whether to provide the first additional award opportunity, and provide the first additional award opportunity when the at least one processor determines to provide the first additional award opportunity.

40. The non-transitory computer readable medium of claim 29, wherein the plurality of instructions, when executed by the at least one processor, cause the at least one processor to cause the at least one display device to change the displayed background responsive to an occurrence of a background change event, wherein the background change event occurs responsive to one of: a change in the time of year and a change in the time of day.

41. The non-transitory computer readable medium of claim 29, wherein the plurality of instructions, when executed by the at least one processor, cause the at least one processor to cause the at least one display device to display the first background for a period encompassing multiple consecutive plays of the game regardless of outcomes of the plays of the game.

* * * * *